US009080120B2

(12) United States Patent
Adams et al.

(10) Patent No.: US 9,080,120 B2
(45) Date of Patent: Jul. 14, 2015

(54) USES AND COMPOSITIONS

(75) Inventors: Ieuan Stephen Adams, Berkshire (GB); Rana Ali, Berkshire (GB); John Philip Davies, Berkshire (GB); Kevin Richard West, Berkshire (GB)

(73) Assignee: Castrol Limited (GB)

( * ) Notice: Subject to any disclaimer, the term of this patent is extended or adjusted under 35 U.S.C. 154(b) by 25 days.

(21) Appl. No.: 13/701,965

(22) PCT Filed: Jun. 21, 2011

(86) PCT No.: PCT/GB2011/000934

§ 371 (c)(1),
(2), (4) Date: Dec. 4, 2012

(87) PCT Pub. No.: WO2011/161406

PCT Pub. Date: Dec. 29, 2011

(65) Prior Publication Data

US 2013/0072408 A1 Mar. 21, 2013

(30) Foreign Application Priority Data

Jun. 25, 2010 (EP) ..... 10251150

(51) Int. Cl.

| | |
|---|---|
| ***C10M 105/32*** | (2006.01) |
| ***C10M 105/36*** | (2006.01) |
| ***C10M 105/38*** | (2006.01) |
| ***C10M 129/95*** | (2006.01) |
| ***C10L 1/19*** | (2006.01) |
| ***C10L 10/08*** | (2006.01) |
| ***C10M 129/76*** | (2006.01) |
| ***C10M 129/28*** | (2006.01) |

(52) U.S. Cl.

CPC ..... *C10L 1/1905* (2013.01); *C10L 1/191* (2013.01); *C10L 10/08* (2013.01); *C10M 129/28* (2013.01); *C10M 129/76* (2013.01); *C10M 2203/1025* (2013.01); *C10M 2207/289* (2013.01); *C10M 2223/045* (2013.01); *C10N 2230/06* (2013.01); *C10N 2240/10* (2013.01)

(58) Field of Classification Search

CPC ..... C10L 1/1905; C10L 10/08; C10L 1/191; C10M 129/28; C10M 129/76; C10M 2207/289; C10M 2203/1025; C10M 2223/045; C10N 2203/06; C10N 2240/10; C10N 2230/02

USPC ..... 508/486, 492, 497, 577, 583

See application file for complete search history.

(56) References Cited

U.S. PATENT DOCUMENTS

| | | | | |
|---|---|---|---|---|
| 3,826,675 | A | 7/1974 | Smith et al. | |
| 3,933,659 | A | 1/1976 | Lyle et al. | |
| 3,970,570 | A | 7/1976 | Pratt et al. | |
| 4,304,678 | A | 12/1981 | Schick et al. | |
| 4,375,360 | A | 3/1983 | Washecheck et al. | |
| 4,376,711 | A | 3/1983 | Shaub | |
| 4,609,376 | A | 9/1986 | Craig et al. | |
| 4,764,296 | A | 8/1988 | Kennedy | |
| 4,820,431 | A | 4/1989 | Kennedy | |
| 5,260,466 | A | 11/1993 | McGibbon | |
| 5,338,470 | A | 8/1994 | Hiebert et al. | |
| 5,415,792 | A * | 5/1995 | Campbell | 508/459 |
| 5,458,795 | A * | 10/1995 | Lawate | 508/481 |
| 5,665,683 | A | 9/1997 | Froeschmann | |
| 5,770,185 | A | 6/1998 | Wachter et al. | |
| 5,993,498 | A | 11/1999 | Vrahopoulou et al. | |
| 6,831,107 | B2 | 12/2004 | Dederen et al. | |
| 6,843,916 | B2 | 1/2005 | Burrington et al. | |
| 7,256,162 | B2 | 8/2007 | Pollock et al. | |
| 7,651,987 | B2 | 1/2010 | Kocsis et al. | |
| 7,678,747 | B2 | 3/2010 | Roby et al. | |
| 7,807,611 | B2 | 10/2010 | Kocsis et al. | |
| 2003/0069146 | A1 | 4/2003 | Garmier | |
| 2003/0220208 | A1 | 11/2003 | Lantuejoul et al. | |
| 2005/0070449 | A1 | 3/2005 | Roby et al. | |
| 2005/0070450 | A1 | 3/2005 | Roby et al. | |
| 2005/0198894 | A1 | 9/2005 | Migdal et al. | |
| 2006/0090393 | A1 | 5/2006 | Rowland et al. | |
| 2008/0176778 | A1 | 7/2008 | Seemeyer et al. | |
| 2009/0011964 | A1 | 1/2009 | Wen et al. | |
| 2009/0082236 | A1 | 3/2009 | Wen et al. | |
| 2009/0152502 | A1 | 6/2009 | Muller et al. | |
| 2009/0197783 | A1 | 8/2009 | Roby et al. | |
| 2009/0275491 | A1 * | 11/2009 | Komatsubara et al. | 508/192 |
| 2010/0081592 | A1 | 4/2010 | Kocsis et al. | |

(Continued)

FOREIGN PATENT DOCUMENTS

| | | |
|---|---|---|
| CA | 1 120 023 | 3/1982 |
| EP | 0 092 946 A2 | 11/1983 |

(Continued)

OTHER PUBLICATIONS

Thiel, C.Y., et al; "The Fuel Additive/Lubricant Interactions: Compatibility Assessments in Field Studies and Laboratory Tests"; *SAE Technical Pater Series*, (14 pgs), 2001-01-1962.

ACS Registry Copyright 2010 ACS on STN; Entered STN: Dec. 26, 2007 (1 pg); Database: NIST Chemistry WebBook (National Institute of Standards and Technology).

Grindsted® Citrem N 12 Veg Kosher, Product Description—PD 154-12.3EN, Material No. 093224, (2 pgs)—Danisco—publication date unknown but received Feb. 3, 2009.

(Continued)

*Primary Examiner* — Pamela H Weiss

(57) ABSTRACT

The use of an oil-soluble mono-, di-, or tri-glyceride of at least one hydroxy polycarboxylic acid, or a derivative thereof, as an anti-wear additive and/or friction modifier in a non-aqueous lubricant composition and/or in a fuel composition. Also, a non-aqueous lubricant composition and a fuel composition for an internal combustion engine which comprise at least one additive which is an oil-soluble mono-, di-, or tri-glyceride of at least one hydroxy polycarboxylic acid, or a derivative thereof.

65 Claims, No Drawings

(56) References Cited

U.S. PATENT DOCUMENTS

| | | | | |
|---|---|---|---|---|
| 2010/0087319 | A1 | 4/2010 | Mainx et al. | |
| 2010/0093573 | A1 * | 4/2010 | Kocsis et al. | 508/287 |
| 2010/0173812 | A1 | 7/2010 | Kocsis et al. | |
| 2010/0197536 | A1 | 8/2010 | Mosier et al. | |
| 2010/0210487 | A1 | 8/2010 | Deblase et al. | |
| 2010/0227784 | A1 | 9/2010 | Kocsis et al. | |
| 2011/0059877 | A1 * | 3/2011 | Obiols et al. | 508/186 |
| 2011/0131868 | A1 | 6/2011 | Kocsis et al. | |

FOREIGN PATENT DOCUMENTS

| | | | | |
|---|---|---|---|---|
| EP | 1 533 362 | A1 | | 5/2005 |
| FR | 2 924 439 | A1 | | 6/2009 |
| GB | 2 097 813 | A | | 11/1982 |
| JP | 07268369 | A | * | 10/1995 |
| WO | WO 93/21288 | A1 | | 10/1993 |
| WO | WO 94/17160 | A1 | | 8/1994 |
| WO | WO 00/33806 | A1 | | 6/2000 |
| WO | WO 2005/087904 | A2 | | 9/2005 |
| WO | WO 2006/044411 | A1 | | 4/2006 |
| WO | WO 2007/092724 | A2 | | 8/2007 |
| WO | WO 2007/148047 | A1 | | 12/2007 |
| WO | WO 2008/008864 | A2 | | 1/2008 |
| WO | WO 2008/032284 | A2 | | 3/2008 |
| WO | WO 2008/067259 | A1 | | 6/2008 |
| WO | WO 2008/070307 | A2 | | 6/2008 |
| WO | WO 2008/124191 | A1 | | 10/2008 |
| WO | WO 2008/135602 | A2 | | 11/2008 |
| WO | WO 2008/147700 | A1 | | 12/2008 |
| WO | WO 2008/147701 | A1 | | 12/2008 |
| WO | WO 2008/147704 | A1 | | 12/2008 |
| WO | WO 2009/101276 | A1 | | 8/2009 |
| WO | WO 2009101276 | A1 | * | 8/2009 |
| WO | WO 2010/005921 | A1 | | 1/2010 |
| WO | WO 2010/053893 | A1 | | 5/2010 |
| WO | WO 2010/093519 | A1 | | 8/2010 |
| WO | WO 2010/104609 | A2 | | 9/2010 |
| WO | WO 2010/112158 | A1 | | 10/2010 |
| WO | WO 2011/005635 | A1 | | 1/2011 |
| WO | WO 2012/056191 | A1 | | 5/2012 |

OTHER PUBLICATIONS

Grindsted Citrem SP 70 Kosher, Product Description—PD 562-14. 3EN, Material No. 172734, (2 pgs)—Danisco—publication date unknown but received Feb. 3, 2009.

Aditiva ingredients & specialties—product sheet (2 pgs), date unknown.

Ponomarenko, A.G., et al; "Research of tribo-chemical processes with the involvement of complex hydrocarboxylic acids ester"; *Fraction and wear and tear*, vol. 9, No. 2, Mar.-Apr. 1988, pp. 305-10 (with translation).

Citrate—Wikipedia, the free encyclopedia webpage, http://en.wikipedia.org/wiki/Citrate, (2pgs), May 28, 2009.

Tartarate—Wikipedia, the free encyclopedia webpage, http://en.wikipedia.org/wiki/Tartrate, (1 pg), May 28, 2009.

Diglyceride—Wikipedia, the free encyclopedia webpage, http://en.wikipedia.org/wiki/Diglyceride, (3pgs), Feb. 12, 2010.

Citric acid esters—Danisco A/S webpage, http://danisco.dk/wps/wcm/connect/danisco/corporate/products+and+services/. . . , (2 pgs), Jan. 20, 2010.

Product Overview—The whole range of our emulsifiers, compounds and functional ingredients at a glance, (1 pg), Apr. 28, 2010.

Thiel, C.Y., et al; "The Fuel Additive/Lubricant Interactions . . . "; *SAE Paper*, 2001-01-1962.

ACS Registry entry Dec. 26, 2007.

Grindsted Citrem N 12 Veg Kosher datasheet—Danisco—publication date unknown but received Feb. 3, 2009.

Grindsted citrem SP 70 Kosher datasheet—Danisco—publication date unknown but received Feb. 3, 2009.

Aditiva—product sheet, date unknown.

Ponomarenko, G.P., et al; "Study of tribochemical processes involving esters of hydrocarboxylic acids", Treni I Iznos (1988), 9(2) 305-10 with translation.

Wikipedia webpage—Citrate—May 28, 2009.

Wikipedia webpage—Tartarate—May 28, 2009.

Wikipedia webpage—Diglyceride—Feb. 12, 2010.

Danisco webpage—Citric acid esters—Jan. 20, 2010.

Product Overview—Apr. 28, 2010.

Intl Search Report and the Written Opinion of the Intl Searching Authority; Form PCT/ISA/220; PCT/GB2011/000934; Int'l Filing Date Jun. 21, 2011 (9 pgs).

* cited by examiner

USES AND COMPOSITIONS

This application is the U.S. national phase of International Application No. PCT/GB2011/000934 filed 21 Jun. 2011 which designated the U.S. and claims priority to European Patent Application No. 10251150.8 filed 25 Jun. 2010, the entire contents of each of which are hereby incorporated by reference.

This invention relates to anti-wear additives and friction modifiers and their use in lubricant compositions and fuel compositions.

It is known to use anti-wear additives and/or friction modifiers in lubricant compositions. It is also known to use anti-wear additives and/or friction modifiers in fuel compositions for internal combustion engines.

The ingress of fuel and fuel additives into the crankcase lubricant of an internal combustion engine is known, for example from paragraph 2 of the abstract of SAE paper 2001-01-1962 by C. Y. Thiel et al. "The Fuel Additive/lubricant Interactions: . . . . "

Zinc dihydrocarbyl dithiophosphates (ZDDP) have been used as anti-wear additives in lubricant compositions for many years. A disadvantage of these additives is that, when used to lubricate internal composition engines, they give rise to ash which contributes to particulate matter in the exhaust emissions from the internal combustion engines. It is therefore desirable to reduce the amount of ash-forming additives used for lubricating internal combustion engines. It is also desirable to reduce the amount of zinc and/or phosphorus and/or sulphur in the exhaust emissions from internal combustion engines. Attempts have therefore been made to provide anti-wear additives and/or friction modifiers which contain neither zinc nor phosphorus or at least contain them in reduced amounts.

U.S. Pat. No. 4,376,711 relates to a lubricant composition and an additive comprising a hydroxy-substituted ester of a polycarboxylic acid and a metal dihydrocarbyl dithiophosphate. According to U.S. Pat. No. 4,376,711, the ester may be derived from the esterification of a polycarboxylic acid with a glycol. It is stated that such an ester may be a partial, di- or polyester. It is also stated that the polycarboxylic acid used in preparing the ester may be an aliphatic saturated or unsaturated acid which will generally have a total of about 24 to about 90 carbon atoms and about 2 to about 3 carboxylic acid groups, with at least about 9 up to about 42 carbon atoms between the carboxylic acid groups. Particularly desirable results are said to have been obtained with additives prepared by esterifying a dimer of a fatty acid, particularly those containing conjugated unsaturation with a polyhydroxy compound. U.S. Pat. No. 4,376,711 does not describe the use of glycerides of hydroxy polycarboxylic acids.

British patent application publication GB-2097813-A relates to fuel economy promoting lubricating oil compositions which comprise an oil of lubricating viscosity and, as the fuel economy additive, from 0.05 to 0.2 weight percent of a glycerol partial ester of a $C_{16}$-$C_{18}$ fatty acid. The composition is illustrated with glycerol monooleate and glycerol dioleate. GB-2097813-A does not describe the use of glycerides of hydroxy polycarboxylic acids.

European patent application publication EP-0092946-A2 relates to glycerol esters with oil-soluble copper compounds as fuel economy additives for lubricant compositions. The preferred ester is said to be a glycerol mono- or di-ester of a saturated or unsaturated $C_{16}$-$C_{18}$ fatty acid. EP-0092946-A2 does not describe the use of glycerides of hydroxy polycarboxylic acids.

International patent application publication WO 93/21288 relates to a lubricant composition containing mixed friction modifiers being a combination of poly fatty acid ester and an alkoxylated hydrocarbylamine. The lubricant compositions are said to exhibit enhanced fuel economy. The esters are said to be one or a mixture of esters of a fatty acid having the formula 3:

3

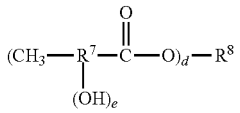

wherein $R^7$ represents an alkylene or alkenylene hydrocarbyl radical having from 10 to 18 carbon atoms, $R^8$ is the residuum of a polyhydric alcohol containing from 2 to 5 carbon atoms and from 2 to 4 hydroxyl groups, e is 0 or 1 and d is an integer of 1, 2 or 3. In more preferred embodiments $R^7$ is said to be an alkylene radical containing 14 to 16 carbon atoms, $R^8$ is the residuum of glycerol, e is 0 and d is 1 or 2. The acid(s) of the esters according to formula 3 are monocarboxylic acids.

U.S. Pat. No. 5,338,470 relates to alkylated citric acid adducts as antiwear and friction modifying additives for fuels and lubricant compositions. The alkylated citric acid adducts are said to be formed by the reaction of citric acid with alkyl alcohols and amines. The reaction is described using nXRy where R is said to be $C_{1-200}$ hydrocarbyl or hydrocarbylene or a mixture thereof, and may optionally contain oxygen, nitrogen or sulphur. "X" is said to be an amine, alcohol, thiol or a metal amide, alkoxide or thiolate. The metal is said to be preferably sodium, potassium or calcium and "n" is a number from 0.2-5.0. Such additives are illustrated only by the reaction of citric acid and oleyl alcohol.

International patent application publication WO 2005/087904 corresponding to US 2005/0198894 relates to lubricant and fuel compositions containing hydroxy carboxylic acid and hydroxy polycarboxylic acid esters represented by the generic formula:

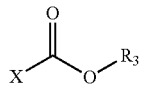

wherein $R_3$ is selected from the group consisting of $C_1$-$C_{18}$ linear or branched alkyl, $C_1$-$C_{18}$ linear or branched alkenyl, alkoxyalkyl, hydroxyalkyl, aryl, and benzyl; and X— is selected from a range of structures defined therein. Preferred esters are said to include citrates, tartrates, malates, lactates, mandelates, glycolates, hydroxy propionates, hydroxyglutarates, salicylates and the like. Trialkyl citrates and borated trialkyl citrates are said to be especially preferred, particularly triethyl citrate and borated triethyl citrate. A particularly preferred class of additives is said to be one wherein $R_3$ is a linear or branched alkyl chain of 1 to 5 carbon atoms, e.g., methyl, ethyl, propyl, butyl, pentyl, isomers of the foregoing, and mixtures thereof. WO 2005/087904 does not describe the use of glycerides of hydroxy polycarboxylic acids.

International patent application publication WO 2008/067259 relates to a low-sulphur, low-phosphorus, low ash lubricant composition suitable for lubricating an internal combustion engine comprising an oil of lubricating viscosity and a condensation product an alcohol of 6 to 12 carbon atoms and a material represented by the formula:

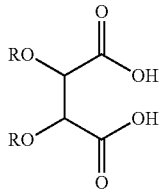

wherein each R is independently H or a hydrocarbyl group, or wherein the R groups together form a ring; and wherein if R is H, the condensation product is optionally further functionalised by acylation or reaction with a boron compound. According to WO 2008/067259 the alcohols useful for preparing the tartrates can contain 6 to 12, or 6 to 10, or 8 to 10 carbon atoms, they may be linear or branched, and, if branched, the branching may occur at any point in the chain and the branching may be of any length. WO 2008/067259 does not describe the use of glycerides of hydroxy polycarboxylic acids.

International patent application publication WO 2008/124191 relates to the use of one or more oil-soluble fatty acid esters of a polyol in a lubricating oil composition having a base oil comprising a major amount of a gas-to-liquid (GTL) derived base oil. Polyols are said to include diols, triols and the like. It is stated therein that the esters of the polyols are those of carboxylic acids having 12 to 24 carbon atoms According to WO 2008/124191 preferably the fatty acid ester is a fatty acid ester of glycerol, more preferably, a monoester of glycerol and most preferably, the ester is glycerol monooctadecanoate. WO 2008/124191 does not describe the use of glycerides of hydroxy polycarboxylic acids.

International patent application publication WO 2008/147701 relates to a lubricating composition suitable for lubricating an aluminium alloy or aluminium composite surface comprising an oil of lubricating viscosity and an ashless antiwear agent which in one embodiment is said to include a compound derived from a hydroxycarboxylic acid. According to WO 2008/147701 in one embodiment the ashless antiwear agent is said to be derived from at least one of a hydroxycarboxylic acid di-ester, a hydroxy-carboxylic acid di-amide, a hydroxy-carboxylic acid di-imide, a hydroxy-carboxylic acid ester-amide, a hydroxy-carboxylic acid ester-imide and a hydroxy-carboxylic acid imide-amide. Examples of suitable hydroxy-carboxylic acids are said to include citric acid, tartaric acid, malic acid, lactic acid, oxalic acid, glycolic acid, hydroxy-propionic acid, hydroxyglutaric acid or mixtures thereof. According to WO 2008/147701 the ashless antiwear agent is represented by a compound of Formula (1a) and/or (1b) defined therein. It is stated therein that the di-esters, di-amides, di-imides, ester-amide, ester-imide, imide-amide compounds of formula (1a) and/or (1b) may be prepared by reacting a dicarboxylic acid (such as tartaric acid), with an amine or alcohol, optionally in the presence of a known esterification catalyst. Derivatives of hydroxycarboxylic acids are said to include imides, di-esters, di-amides, di-imides (applicable for tetra-acids and higher), ester-amides, ester-imides (applicable for tri-acids and higher, such as citric acid), and imide-amides (applicable for tri-acids and higher, such as citric acid). Examples of suitable branched alcohol are said to include 2-ethylhexanol, isotridecanol, Guerbet alcohols or mixtures thereof. Examples of monohydric alcohols are said to include methanol, ethanol, propanol, butanol, pentanol, hexanol, heptanol, octanol, nonanol, decanol, undecanol, dodecanol, tridecanol, tetradecanol, pentadecanol, hexadecanal, heptadecanol, octadecanol, nonadecanol, eicosanol or mixtures thereof. It is also stated that the alcohol includes either a monohydric alcohol or a polyhydric alcohol. Examples of suitable polyhydric alcohols are said to include ethylene glycol, propylene glycol, 1,3-butylene glycol, 2,3-butylene glycol, 1,5-pentane diol, 1,6-hexanediol, glycerol, sorbitol, pentaerythritol, trimethylolpropane, starch, glucose, sucrose, methylglucoside or mixtures thereof. It is also stated in WO 2008/147701 that in one embodiment the polyhydric alcohol is used in a mixture along with a monohydric alcohol. It is stated that typically, in such a combination the monohydric alcohol constitutes at least 60 mole percent, or at least 90 mole percent of the mixture. Di-2-ethylhexyl tartrate is the only ashless anti-wear agent illustrated in the examples.

International patent application publication WO 2009/101276 relates to a lubricant composition for a four stroke engine with low ash content which is said to comprise amongst other components, at least one hydroxylated ester of the formula $R(OH)_m(COOR'(OH)_p)_n$ in which m is an integer from 0 to 8, preferably from 1 to 4, n is an integer from 1 to 8, preferably from 1 to 4, and p is an integer from 0 to 8, preferably from 1 to 4, wherein the sum p+m is strictly higher than zero, R and R' independently represent a linear or branched, saturated or unsaturated hydrocarbon group optionally substituted by one or more aromatic groups and including from 1 to 30 carbon atoms, or the borate derivatives thereof. It is stated that the hydroxylated esters may be chosen from the monoesters or the diesters obtained from glycerol such as glycerol monooleate, glycerol stearate or isostearate and their borated derivatives. It is also stated that the hydroxylated esters may be chosen from the citrates, tartrates, malates, lactates, mandelates, glycolates, hydroxypropionates, hydroxyglutarates or their borated derivatives. The composition is illustrated only with triethyl citrate and glycerol monostearate. In Table 3 of WO 2009/101276, the Cameron Plint fuel economy for a lubricant composition (B') comprising 0.99% triethylcitrate is stated to be 2.02% compared to 1.75% for the lubricant (A') without the triethylcitrate. In Table 5 of WO 2009/101276 the Cameron Plint fuel economy for a lubricant composition (H) comprising 1.00% triethylcitrate is stated to be 2.04% and the M 111 FE fuel economy to be 2.50%, whereas the corresponding data for lubricant F without the triethyl citrate are stated to be 1.78% and 1.90% respectively.

There remains a need for alternative compositions exhibiting anti-wear and/or friction modifier properties for example for use in non-aqueous lubricant compositions and/or for use in internal combustion engine fuel compositions.

Thus, according to the present invention there is provided a non-aqueous lubricant composition comprising a major amount of an oil of lubricating viscosity and a minor amount of at least one additive which is an oil-soluble mono-, di-, or tri-glyceride of at least one hydroxy polycarboxylic acid, or a derivative thereof and more than one other lubricant additive.

Suitably, the lubricant composition may be used to lubricate an internal combustion engine, for example as a crankcase lubricant.

Also according to the present invention, there is provided a method of lubricating an internal combustion engine which method comprises supplying to the engine an oil of lubricating viscosity and at least one additive which is an oil-soluble mono-, di-, or tri-glyceride of at least one hydroxy polycarboxylic acid, or a derivative thereof. Suitably, the internal engine is lubricated with a lubricant composition of the present invention, for example as a crankcase lubricant. Additionally or alternatively, the glyceride may be provided in a liquid fuel composition used to operate the internal combustion engine, at least a portion of the glyceride ingressing into the oil composition during operation of the engine.

Also according to the present invention there is provided a method of improving the antiwear and/or friction properties of an oil of lubricating viscosity which method comprises admixing said oil with an effective amount of at least one additive which is an oil-soluble mono-, di-, or tri-glyceride of at least one hydroxy polycarboxylic acid or a derivative thereof.

Also according to the present invention there is provided a method of preparing a non-aqueous lubricant composition which method comprises admixing an oil of lubricating viscosity with an effective amount of at least one additive which is an oil-soluble mono-, di-, or tri-glyceride of at least one hydroxy polycarboxylic acid, or a derivative thereof together with more than one other lubricant additive.

Also according to the present invention there is provided an additive concentrate for a non-aqueous lubricant composition comprising at least one additive which is an oil-soluble mono-, di-, or tri-glyceride of at least one hydroxy polycarboxylic acid, or a derivative thereof and more than one other lubricant additive. The additive concentrate may be used in the method of improving the antiwear and/or friction properties of an oil of lubricating viscosity according to the present invention. The additive concentrate may be used in the method of preparing a lubricant composition according to the present invention.

According to a further embodiment of the present invention, there is provided a fuel composition for an internal combustion engine which composition comprises a major amount of a liquid fuel and a minor amount of at least one additive which is an oil-soluble mono-, di-, or tri-glyceride of at least one hydroxy polycarboxylic acid, or a derivative thereof at a concentration of up to 500 ppm by weight.

Also according to the present invention there is provided a method of improving the antiwear and/or friction properties of a liquid fuel, which method comprises admixing said liquid fuel with an effective amount of at least one additive which is an oil-soluble mono-, di-, or tri-glyceride of at least one hydroxy polycarboxylic acid, or a derivative thereof and optionally at least one other fuel additive.

Also according to the present invention there is provided a method of preparing a fuel composition for an internal combustion engine, which method comprises admixing a liquid fuel with an effective amount of at least one additive which is an oil-soluble mono-, di-, or tri-glyceride of at least one hydroxy polycarboxylic acid, or a derivative thereof at a concentration of up to 500 ppm by weight.

Also according to the present invention there is provided an additive concentrate for a fuel composition for an internal combustion engine, which composition comprises at least one additive which is an oil-soluble mono-, di-, or tri-glyceride of at least one hydroxy polycarboxylic acid, or a derivative thereof and more than one other fuel additive. The additive concentrate may be used in the method of improving the antiwear and/or friction properties of a liquid fuel according to the present invention. The additive concentrate may be used in the method of preparing a fuel composition according to the present invention.

According to yet a further aspect of the present invention there is provide a method of operating an internal combustion engine which method comprises supplying to the engine a liquid fuel, an oil of lubricating viscosity and at least one additive which is an oil-soluble mono-, di-, or tri-glyceride of at least one hydroxy polycarboxylic acid, or a derivative thereof, the glyceride additive being supplied in admixture with the liquid fuel and/or the oil of lubricating viscosity.

The present invention solves the technical problem defined above by the use as an anti-wear additive and/or friction modifier of an oil-soluble mono-, di-, or tri-glyceride of at least one hydroxy polycarboxylic acid, or a derivative thereof. The use may be in any of the embodiments of the present invention including: the non-aqueous lubricant composition, the method of lubricating an internal combustion engine, the method of improving the antiwear and/or friction properties of an oil of lubricating viscosity, the method of preparing a non-aqueous lubricant composition, the additive concentrate for a non-aqueous lubricant composition, the fuel composition (for example for an internal combustion engine), the method of improving the antiwear and/or friction properties of a liquid fuel, the method of preparing a fuel composition for an internal combustion engine, the additive concentrate for a fuel composition for an internal combustion engine and the method of operating an internal combustion engine.

In a particular aspect, the present invention provides the use of an oil-soluble mono-, di-, or tri-glyceride of at least one hydroxy polycarboxylic acid, or a derivative thereof, as an anti-wear additive and/or friction modifier in a non-aqueous lubricant composition and/or in a fuel composition.

Preferably, the hydroxy polycarboxylic acid has at least one hydroxy group or derivative (for example ether or ester) thereof, which is in an alpha position with respect to a carboxylic moiety.

Each hydroxy polycarboxylic acid may independently have from 4 to 22 carbon atoms, for example 4 to 15 carbon atoms. The oil-soluble mono-, di-, or tri-glyceride of at least one hydroxy polycarboxylic acid or derivative thereof may suitably have from 16 to 80 carbon atoms. The number of carbon atoms in the glyceride may affect its solubility in oil of lubricating viscosity and/or in liquid fuel.

By oil-soluble is meant that the glyceride is soluble in an oil of lubricating viscosity and/or a liquid fuel suitably in a friction modifying and/or antiwear improving amount for example in an amount by weight of at least 200 ppm in an oil of lubricating viscosity and/or in an amount by weight of at least 10 ppm in a liquid fuel. The solubility may be determined at ambient temperature, for example at 20° C. The solubility may be determined at atmospheric pressure.

Suitable hydroxy polycarboxylic acids include:

- citric acid (also sometimes called 3-carboxy-3-hydroxy pentanedioic acid; 2-hydroxypropane-1,2,3-tricarboxylic acid; or 3-hydroxypentanedioic acid-3-carboxylic acid);
- tartaric acid (also sometimes called 2,3-dihydroxybutanedioic acid; or 2,3-dihydroxysuccinic acid);
- malic acid (also sometimes called hydroxybutanedioic acid);
- monohydroxy trimesic acid; and
- hydrogenated monohydroxy trimesic acid (sometimes also called 1,3,5 tricarboxy, 2-hydroxy cyclohexane).

The oil-soluble mono-, di-, or tri-glyceride of at least one hydroxy polycarboxylic acid, or a derivative thereof may be a di-, or tri-glyceride which is a glyceride of at least one hydroxy polycarboxylic acid and at least one second carboxylic acid which is a saturated, mono-unsaturated or poly-unsaturated, branched or linear, monocarboxylic or polycarboxylic acid having 4 to 22 carbon atoms, or a derivative thereof.

The second carboxylic acid may be saturated, mono-unsaturated or poly-unsaturated. Suitably, the second carboxylic acid is unsaturated. The second carboxylic acid may be branched or linear. The second carboxylic acid may be monocarboxylic or polycarboxylic acid. If the second carboxylic acid is a polycarboxylic acid, the derivative of the glyceride may be an ester of the second carboxylic acid group.

Suitable saturated second carboxylic acids include caproic acid, caprylic acid, capric acid, lauric acid, myristic acid, palmitic acid, stearic acid and arachidic acid. Suitable unsaturated second carboxylic acids include oleic acid, linoleic acid, linolenic acid, myristoleic acid, palmitoleic acid, sapienic acid, erucic acid (also known as cis-13-docosenoic acid) and brassidic acid.

Preferably, the glyceride is a glyceride of citric acid and oleic acid, a glyceride of citric acid and linoleic acid or a mixture thereof.

The mono-, di-, or tri-glyceride of at least one hydroxy polycarboxylic acid or derivative thereof may be represented by the general formula (I):

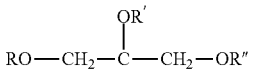

(I)

wherein RO, OR' and OR" independently represent:

—OH;

a saturated, mono-unsaturated or poly-unsaturated, branched or linear, monocarboxylic or polycarboxylic group having from 4 to 22 carbon atoms or an ether or an ester thereof;

a hydroxy polycarboxylic acid moiety or an ether and/or ester thereof provided that at least one of RO, OR' and OR" is a hydroxy polycarboxylic acid moiety or an ether and/or ester thereof.

Preferably, in formula (1) at least one of RO, OR' and OR" is a hydroxy polycarboxylic acid moiety or an ether and/or ester thereof and at least one of RO, OR' and OR" is a saturated, mono-unsaturated or poly-unsaturated, branched or linear, monocarboxylic or polycarboxylic group having from 4 to 22 carbon atoms or an ester thereof.

Preferably in formula (I), the hydroxy polycarboxylic moiety acid has at least one hydroxy group or derivative (for example ether or ester) thereof which is in an alpha position with respect to a carboxylic moiety.

In formula (I), each hydroxy polycarboxylic moiety may independently have from 4 to 22 carbon atoms. In formula (I) the hydroxy polycarboxylic moiety may be derivable from acids including for example citric acid, tartaric acid, malic acid, monohydroxy trimesic acid and hydrogenated monohydroxy trimesic acid.

In formula (I) when present, each saturated, branched or linear, monocarboxylic or polycarboxylic group having from 4 to 22 carbon atoms or an ester thereof may be derivable from saturated carboxylic acids or their halide equivalents. Suitable saturated carboxylic acids include for example, caproic acid, caprylic acid, capric acid, lauric acid, myristic acid, palmitic acid, stearic acid and arachidic acid. In formula (I) when present, each mono-unsaturated or poly-unsaturated, branched or linear, monocarboxylic or polycarboxylic group having from 4 to 22 carbon atoms or an ester thereof may be derivable from unsaturated carboxylic acids or their halide equivalents. Suitable mono-unsaturated acids include for example, oleic acid, myristoleic acid, palmitoleic acid, sapienic acid, erucic acid and brassidic acid. Suitable polyunsaturated acids include for example linoleic acid and linolenic acid, The glyceride may be a glyceride of at least one hydroxy polycarboxylic acid and a saturated $C_4$ to $C_{22}$ polycarboxylic acid, or a derivative thereof. The polycarboxylic acid may be branched or linear. The glyceride may be a glyceride of at least one hydroxy polycarboxylic acid and a mono-unsaturated or polyunsaturated $C_4$ to $C_{22}$ polycarboxylic acid, or a derivative thereof. The polycarboxylic acid may be branched or linear. The glyceride may be a glyceride of at least one hydroxy polycarboxylic acid and a saturated $C_4$ to $C_{22}$ monocarboxylic acid, or a derivative thereof. The monocarboxylic acid may be branched or linear. Suitable saturated $C_{16}$ monocarboxylic acids include palmitic acid. Suitable saturated $C_{18}$ monocarboxylic acids include stearic acid. The glyceride may be a glyceride of at least one hydroxy polycarboxylic acid and a mono-unsaturated or polyunsaturated $C_4$ to $C_{22}$ monocarboxylic acid, or a derivative thereof. The unsaturated monocarboxylic acid may be branched or linear. The glyceride may be a glyceride of at least one hydroxy polycarboxylic acid and an unsaturated $C_{18}$ monocarboxylic acid, or a derivative thereof. The monocarboxylic acid may be branched or linear. Suitable hydroxy polycarboxylic acids include citric acid. The glyceride additive may be a glyceride of citric acid and an unsaturated $C_{18}$ monocarboxylic acid, or a derivative thereof. Suitable unsaturated $C_{18}$ monocarboxylic acids include oleic acid and linoleic acid.

The glyceride may be a citric acid ester of a mono-glyceride of a saturated, mono-unsaturated or polyunsaturated, branched or linear, monocarboxylic or polycarboxylic $C_4$ to $C_{22}$ carboxylic acid, suitably a $C_{16}$ or $C_{18}$ carboxylic acid for example, palmitic acid, stearic acid, oleic acid or linoleic acid. The glyceride may be a citric acid ester of mono-glyceride made from vegetable oil, for example sunflower and/or palm oil. The glyceride may be a citric acid ester of mono-glyceride made from edible, refined sunflower and palm based oil. Preferably, the glyceride is a glyceride of citric acid and oleic acid, a glyceride of citric acid and linoleic acid or a mixture thereof. A suitable source of glycerides of citric acid with oleic acid and/or linoleic acid is GRINSTED CITREM SP70 (Trade Mark) which is available from Danisco. GRINSTED CITREM SP70 is believed to be a citric acid ester of mono-glyceride made from edible, refined sunflower and palm based oil. GRINSTED CITREM SP70 is also believed to comprise at least one diglyceride having the structural formula (II):

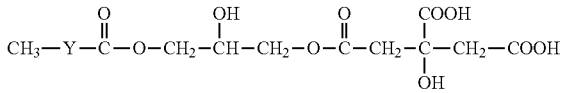

(II)

wherein —Y— represents a $C_{16}$ hydrocarbyl moiety which is mono- or di-unsaturated.

Thus, diglycerides having structural formula (II) include a glyceride of citric acid and oleic acid and a glyceride of citric acid and linoleic acid. This corresponds to a structure of formula (I) in which (i) RO represents a carboxyl group having 18 carbon atoms, which may be derivable from oleic acid and/or linoleic acid, (ii) OR' represents a hydroxyl moiety, and (iii) OR" represents a hydroxy polycarboxylic acid moiety, which may be derivable from citric acid.

GRINSTED® CITREM N 12 VEG from Danisco is believed to be a neutralised citric acid ester of mono-glyceride made from edible, fully hydrogenated palm based oil. It was found to be unsuitable because it was not oil soluble.

The use of GRINSTED® CITREM 2-IN-1 from Danisco as a carboxylic acid anionic surfactant is described in paragraphs [0167] to [0171] of US patent application publication US 2008/0176778. US 2008/0176778 relates to conveyor lubricants including emulsion of a lipophilic compound and an emulsifier and/or an anionic surfactant (title). The lipophilic compound is said to include water insoluble organic compounds including two or more ester linkages and in one embodiment is said to be a water insoluble organic compound including three or more oxygen atoms. It is stated that in one embodiment, the lipophilic compound is an ester including a di-, tri-, or poly-hydric alcohol, such as glycerol, with 2 or more of the hydroxyl groups each being coupled to a carboxylic acid as an ester group (para. [0033]). In the example at para. [0167] to [0171] two triglyceride lubricant compositions were tested. Lubricant A was said to contain an emulsion of 10 wt % of a caprylate, caprate, cocoate triglyceride in water to which was added the anionic surfactant 1.5 wt % lecithin (sold under the trade name Terradrill V408, Cognis) and the emulsifier 1.5 wt % 20 mol ethoxysorbitan monostearate (sold under the trade name Tween 60V, ICI). Lubricant B was said to contain 1.5 wt % citrate ester, said to be a carboxylic acid anionic surfactant sold under the name GRINSTED® CITREM 2-IN-1, Danisco in place of the Terradrill V408. According to para. [0171], Triglyceride lubricants including anionic surfactant worked well as dry conveyor lubricants and effectively lubricated after water was applied to the conveyor. According to para. [0061] of US 2008/0176778 the composition therein can include any variety of anionic surfactants that are effective to increase the ability of the lipophilic emulsion to withstand application of water to the conveyor. Examples are given in para [0065] to [0075] of ten classes of anionic surfactant.

According to para [0029] of US patent application publication US 2009/0152502, hydrophilic emulsifier CITREM is a composition of matter containing citric esters of mono- and diglycerides of edible fatty acids. It is also stated therein that edible fatty acids have, in particular, 6 to 24 carbon atoms.

The glyceride may be an ester of citric acid with a partial glyceride, for example mono- or di-glyceride or mixtures thereof, which have free hydroxyl groups. Suitable partial glycerides include those derived from fatty acids with 12 to 18 carbon atoms, including for example those derived from coconut oil fatty acids and palm oil fatty acids. Examples include Lamegin® ZE 306, Lamegin® ZE 609 and Lamegin® ZE 618 (Cognis Deutschland GmbH & Co. KG). Thus the glyceride may be a citric acid ester of the monoglyceride of hydrogenated tallow fatty acid, for example Lamegin® ZE 309, or an ester of diacetyl tartaric acid with monoglyceride of hydrogenated tallow fatty acid, for example Lamegin® DW 8000, or citric acid ester based on sunflower oil fatty acid monoglyceride, for example Lamegin® ZE 609 FL. Such esters are described for example in U.S. Pat. No. 5,770,185 and US 2010/0087319.

The derivative of the glyceride may be an ester of the at least one hydroxy polycarboxylic acid moiety. The ester may be an ester of a carboxylic acid moiety of the hydroxy polycarboxylic acid. Each carboxylic acid moiety of the hydroxyl polycarboxylic acid may be independently derivatisable as an ester. The ester derivative may be a hydrocarbyl ester, in which the hydrocarbyl moiety may have from 4 to 22 carbon atoms. The hydrocarbyl moiety may be an alkyl moiety which may have from 4 to 22 carbon atoms. The hydrocarbyl moiety may comprise one or more hetero atoms for example nitrogen and/or oxygen.

The derivative of the glyceride may be an ether or an ester of the hydroxyl moiety of the hydroxy polycarboxylic acid. If more than one hydroxy moiety is present in the mono-, di-, or tri-glyceride of at least one hydroxy polycarboxylic acid, each hydroxyl moiety may independently be derivatisable as an ether or an ester. Each ether may be a hydrocarbyl ether. The hydrocarbyl moiety of each ether may independently have from 1 to 22 carbon atoms, more suitably from 1 to 18 carbon atoms. The hydrocarbyl moiety of each ether may independently be an alkyl moiety. The alkyl moiety of each ether may independently have from 1 to 22 carbon atoms, more suitably from 1 to 18 carbon atoms. The hydrocarbyl moiety of each ether may independently comprise one or more hetero atoms for example nitrogen and/or oxygen. Each ester may independently be a hydrocarbyl ester. The hydrocarbyl moiety of each ester may have from 4 to 22 carbon atoms. The hydrocarbyl moiety of each ester may independently be an alkyl moiety. The alkyl moiety of each ester may independently have from 4 to 22 carbon atoms. The hydrocarbyl moiety of each ester may independently comprise one or more hetero atoms for example nitrogen and/or oxygen.

If the saturated, mono-unsaturated or polyunsaturated, branched or linear carboxylic acid having 4 to 22 carbon atoms is a polycarboxylic acid, the derivative of the glyceride may be an ester of a carboxylic acid moiety of one or more of the at least one saturated, mono-unsaturated or poly-unsaturated, branched or linear, polycarboxylic acid having from 4 to 22 carbon atoms, if present. Each ester may independently be a hydrocarbyl ester. The hydrocarbyl moiety of each ester may independently have from 4 to 22 carbon atoms. The hydrocarbyl moiety may be an alkyl moiety. The alkyl moiety of each ester may independently have from 4 to 22 carbon atoms. The hydrocarbyl moiety of each ester may independently comprise one or more hetero atoms for example nitrogen and/or oxygen.

The oil-soluble mono-, di-, or tri-glycerides of at least one hydroxy polycarboxylic acid and derivatives thereof may be made by methods known in the art. The di- and tri-glycerides may be made by partial hydrolysis of a fat to produce a mono-glyceride followed by esterification with a hydroxy polycarboxylic acid. The mono-glycerides may be made by esterification of glycerol with a hydroxy polycarboxylic acid. Hydrocarbyl ether derivatives may be made from corresponding hydrocarbyl halides.

The oil-soluble mono-, di-, or tri-glycerides of at least one hydroxy polycarboxylic acid and derivatives thereof have an advantage that they do not contain zinc or molybdenum, that is, they are molybdenum-free and zinc-free. They also have an advantage that they are sulphur-free and phosphorus-free. Generally, the additives according to the present invention will have low volatility.

Some advantages of GRINSTED CITREM SP70 (Trade Mark) are that it has low volatility and has low toxicity.

Lubricant Compositions and Additive Concentrates for Lubricant Compositions.

The amount of oil-soluble mono-, di-, or tri-glyceride of at least one hydroxy polycarboxylic acid, or a derivative thereof in the lubricant composition may be in the range of 0.02% to 5% by weight, preferably in the range of 0.1 to 2.5% by weight.

The non-aqueous lubricant composition is not an emulsion.

The concentration of oil-soluble mono-, di-, or tri-glyceride of at least one hydroxy polycarboxylic acid, or a derivative thereof in the additive concentrate may be an amount suitable to provide the required concentration when used in the lubricant composition. The additive concentrate may be used in a lubricant composition in an amount of 0.5 to 20% by weight. Therefore, the amount of oil-soluble mono-, di-, or tri-glyceride of at least one hydroxy polycarboxylic acid, or a derivative thereof additive and any other additives in the lubricant concentrate may be more concentrated than that in the lubricant composition, for example by a factor of from 1:0.005 to 1:0.20.

The lubricant composition comprises a major amount of oil of lubricating viscosity and a minor amount of at least one additive. Major amount means greater than 50% and minor amount means less than 50% by weight.

The lubricant composition and the oil of lubricating viscosity may comprise base oil. Base oil comprises at least one base stock. The oil of lubricating composition may comprise one or more additives other than the mono-, di-, or tri-glyceride of at least one hydroxy polycarboxylic acid. Suitably, the lubricant composition and/or the oil of lubricating viscosity comprises base oil in an amount of from greater than 50% to about 99.5% by weight, for example from about 85% to about 95% by weight.

The base stocks may be defined as Group I, II, III, IV and V base stocks according to API standard 1509, "ENGINE OIL LICENSING AND CERTIFICATION SYSTEM", April 2007 version 16$^{th}$ edition Appendix E, as set out in Table 1.

Group I, Group II and Group III base stocks may be derived from mineral oils Group I base stocks are typically manufactured by known processes comprising solvent extraction and solvent dewaxing, or solvent extraction and catalytic dewaxing. Group II and Group III base stocks are typically manufactured by known processes comprising catalytic hydrogenation and/or catalytic hydrocracking, and catalytic hydroisomerisation. A suitable Group I base stock is AP/E core 150, available from ExxonMobil. Suitable Group II basestocks are EHC 50 and EHC 110, available from ExxonMobil. Suitable group III base stocks include Yubase 4 and Yubase 6 available for example, from SK Lubricants. Suitable Group V base stocks are ester base stocks, for example Priolube 3970, available from Croda International plc. Suitable Group IV base stocks include hydrogenated oligomers of alpha olefins. Suitably, the oligomers may be made by free radical processes, Zeigler catalysis or by cationic Friedel-Crafts catalysis. Polyalpha olefin base stocks may be derived from C8, C10, C12, C14 olefins and mixtures of one or more thereof.

TABLE 1

| Group | Saturated hydrocarbon content (% by weight) ASTM D2007 | | Sulphur content (% by weight) ASTM D2622 or D4294 or D4927 or D3120 | | Viscosity Index ASTM D2270 |
|---|---|---|---|---|---|
| I | <90 | and/or | >0.03 | and | ≥80 and <120 |
| II | ≥90 | and | ≤0.03 | and | ≥80 and <120 |
| III | ≥90 | and | ≤0.03 | and | ≥120 |
| IV | | | polyalpha olefins | | |
| V | | | all base stocks not in Groups I, II, III or IV | | |

The lubricant composition and the oil of lubricating viscosity may comprise one or more base oil and/or base stock which is/are natural oil, mineral oil (sometimes called petroleum-derived oil or petroleum-derived mineral oil), non-mineral oil and mixtures thereof. Natural oils include animal oils, fish oils, and vegetable oils. Mineral oils include paraffinic oils, naphthenic oils and paraffinic-naphthenic oils. Mineral oils may also include oils derived from coal or shale.

Suitable base oils and base stocks oils may be derived from processes such as chemical combination of simpler or smaller molecules into larger or more complex molecules (for example polymerisation, oligomerisation, condensation, alkylation, acylation).

Suitable base stocks and base oils may be derived from gas-to-liquids materials, coal-to-liquids materials, biomass-to-liquids materials and combinations thereof.

Gas-to-liquids (sometimes also referred to as GTL materials) may be obtained by one or more process steps of synthesis, combination, transformation, rearrangement, degradation and combinations of two or more thereof applied to gaseous carbon-containing compounds. GTL derived base stocks and base oils may be obtained from the Fischer-Tropsch synthesis process in which synthesis gas comprising a mixture of hydrogen and carbon monoxide is catalytically converted to hydrocarbons, usually waxy hydrocarbons that are generally converted to lower-boiling materials hydroisomerisation and/or dewaxing (see for example, WO 2008/124191).

Biomass-to-liquids (sometimes also referred to as BTL materials) may be manufactured from compounds of plant origin for example by hydrogenation of carboxylic acids or triglycerides to produce linear paraffins, followed by hydroisomerisation to produced branched paraffins (see for example, WO-2007-068799-A).

Coal-to-liquids materials may be made by gasifying coal to make synthesis gas which is then converted to hydrocarbons.

The base oil and/or oil of lubricating viscosity may have a kinematic viscosity at 100° C. in the range of 2 to 100 cSt, suitably in the range of 3 to 50 cSt and more suitably in the range 3.5 to 25 cSt.

The lubricant composition of the present invention may be a multi-grade lubricating oil composition according to the API classification xW-y where x is 0, 5, 10, 15 or 20 and y is 20, 30, 40, 50 or 60 as defined by SAE J300 2004, for example 5W-20, 5W-30, 0W-20. The lubricant composition may have an HTHS viscosity at 150° C. of at least 2.6 cP, for example as measured according to ASTM D4683, CEC L-36-A-90 or ASTM D5481.

The lubricant composition may have an HTHS viscosity at 150° C. according to ASTM D4683 of from 1 to <2.6 cP, for example about 1.8 cP.

The lubricant composition may be prepared by admixing an oil of lubricating viscosity with an effective amount of at least one additive which is an oil-soluble mono-, di-, or tri-glyceride of at least one hydroxy polycarboxylic acid, or a derivative thereof together with more than one other lubricant additive.

The method of preparing a lubricant composition and the method of improving the antiwear and/or friction properties of an oil of lubricating viscosity comprise admixing an oil of lubricating viscosity with an effective amount of at least one additive which is an oil-soluble mono-, di-, or tri-glyceride of at least one hydroxy polycarboxylic acid, or a derivative thereof.

The oil of lubricating viscosity may be admixed with at least one additive in one or more steps by methods known in the art. The additives may be admixed as one or more additive concentrates or part additive package concentrates, optionally comprising solvent or diluent. The oil of lubricating viscosity may be prepared by admixing in one or more steps by methods known in the art, one or more base oils and/or base stocks optionally with one or more additives and/or part additive package concentrates. The additives, additive concentrates and/or part additive package concentrates may be admixed with oil of lubricating viscosity or components thereof in one or more steps by methods known in the art Other Anti-Wear Additives The lubricant composition and the additive concentrate for a lubricant composition may further comprise at least one anti-wear additive other than the additive which is an oil-soluble mono-, di-, or tri-glyceride of at least one hydroxy polycarboxylic acid, or a derivative thereof. Such other anti-wear additives may be ash-producing additives or ashless additives. Examples of such other anti-wear additives include non-phosphorus containing additives for example, sulphurised olefins. Examples of such other anti-wear additives also include phosphorus-containing antiwear additives. Examples of suitable ashless phosphorus-containing anti-wear additives include trilauryl phosphite and triphenylphosphorothionate and those disclosed in paragraph [0036] of US2005/0198894. Examples of suitable ash-forming, phosphorus-containing anti-wear additives include dihydrocarbyl dithiophosphate metal salts. Examples of suitable metals of the dihydrocarbyl dithiophosphate metal salts include alkali and alkaline earth metals, aluminium, lead, tin, molybdenum, manganese, nickel, copper and zinc. Particularly suitable dihydrocarbyl dithiophosphate metal salts are zinc dihydrocarbyl dithiophosphates (ZDDP). The ZDDP's may have hydrocarbyl groups independently having 1 to 18 carbon atoms, suitably 2 to 13 carbon atoms or 3 to 18 carbon atoms, more suitably 2 to 12 carbon atoms or 3 to 13 carbon atoms, for example 3 to 8 carbon atoms. Examples of suitable hydrocarbyl groups include alkyl, cycloalkyl and alkaryl groups which may contain ether or ester linkages and also which may contain substituent groups for example, halogen or nitro groups. The hydrocarbyl groups may be alkyl groups which are linear and/or branched and suitably may have from 3 to 8 carbon atoms. Particularly suitable ZDDP's have hydrocarbyl groups which are a mixture of secondary alky groups and primary alkyl groups for example, 90 mol. % secondary alkyl groups and 10 mol. % primary alkyl groups.

The oil-soluble mono-, di-, or tri-glyceride of at least one hydroxy polycarboxylic acid, or a derivative thereof additive may reduce the amount of phosphorus- and/or zinc-containing anti-wear additive which might be required to achieve a desired amount of anti-wear properties for the lubricant composition.

Phosphorus-containing anti-wear additives may be present in the lubricating oil composition at a concentration of 10 to 6000 ppm by weight of phosphorus, suitably 10 to 1000 ppm by weight of phosphorus, for example 200 to 1400 ppm by weight of phosphorus, or 200 to 800 ppm by weight of phosphorus or 200 to 600 ppm by weight of phosphorus.

It has been found that the presence in the lubricant composition of at least one oil-soluble mono-, di-, or tri-glyceride of at least one hydroxy polycarboxylic acid, or a derivative thereof may assist in the performance of anti-wear additives, such as for example zinc dihydrocarbyl dithiophosphate additives. This may have an advantage of reducing the amount of metals, for example zinc, present in the lubricant composition. This may also have an advantage of reducing the amount of phosphorus-containing anti-wear additives in the lubricant composition which in turn may reduce the amount of phosphorus in the exhaust emissions when the lubricant is used to lubricate an internal combustion engine. The reduction in the amount of phosphorus in the exhaust emissions may have benefits for any exhaust after treatment system.

Other Friction Modifiers.

The lubricant composition and the additive concentrate for a lubricant composition may further comprise at least one friction modifier other than the additive which is oil-soluble mono-, di-, or tri-glyceride of at least one hydroxy polycarboxylic acid, or a derivative thereof. Such other friction modifiers may be ash-producing additives or ashless additives. Examples of such other friction modifiers include fatty acid derivatives including for example, fatty acid esters, amides, amines, and ethoxylated amines. Examples of suitable ester friction modifiers include esters of glycerol for example, mono-, di-, and tri-oleates, mono-palmitates and mono-myristates. A particularly suitable fatty acid ester friction modifier is glycerol monooleate. Examples of such other friction modifiers may also include molybdenum compounds for example, organo molybdenum compounds, molybdenum dialkyldithiocarbamates, molybdenum dialkylthiophosphates, molybdenum disulphide, tri-molybdenum cluster dialkyldithiocarbamates, non-sulphur molybdenum compounds and the like. Suitable molybdenum-containing compounds are described for example, in EP-1533362-A1 for example in paragraphs [0101] to [0117].

Friction modifiers other than the additive which is oil-soluble mono-, di-, or tri-glyceride of at least one hydroxy polycarboxylic acid, or a derivative thereof may also include a combination of an alkoxylated hydrocarbyl amine and a polyol partial ester of a saturated or unsaturated fatty acid or a mixture of such esters, for example as described in WO 93/21288.

The additive of the present invention may be used as an alternative to other friction modifiers or may reduce the amount of such other friction modifiers which might be required to achieve a desired friction property for the lubricant composition. This may have an advantage of reducing the amount of metals, for example molybdenum, present in the lubricant composition.

Friction modifiers other than the additive which is oil-soluble mono-, di-, or tri-glyceride of at least one hydroxy polycarboxylic acid, or a derivative thereof which are fatty acid derivative friction modifiers may be present in the lubricating oil composition at a concentration of 0.01 to 5% by weight actives, more suitably in the range of 0.01 to 1.5% by weight actives.

Molybdenum containing friction modifiers may be present in the lubricating oil composition at a concentration of 10 to 1000 ppm by weight molybdenum, more suitably in the range of 400 to 600 ppm by weight.

Other Additives.

The lubricant composition and the additive concentrate for a lubricant composition may also comprise other additives. Examples of such other additives include dispersants (metallic and non-metallic), dispersant viscosity modifiers, detergents (metallic and non-metallic), viscosity index improvers, viscosity modifiers, pour point depressants, rust inhibitors, corrosion inhibitors, antioxidants (sometimes also called oxidation inhibitors), anti-foams (sometimes also called anti-foaming agents), seal swell agents (sometimes also called seal compatibility agents), extreme pressure additives (metallic, non-metallic, phosphorus containing, non-phosphorus containing, sulphur containing and non-sulphur containing), surfactants, demulsifiers, anti-seizure agents, wax modifiers, lubricity agents, anti-staining agents, chromophoric agents and metal deactivators.

Dispersants

Dispersants (also called dispersant additives) help hold solid and liquid contaminants for example resulting from oxidation of the lubricant composition during use, in suspension and thus reduce sludge flocculation, precipitation and/or deposition for example on lubricated surfaces. They generally comprise long-chain hydrocarbons, to promote oil-solubility, and a polar head capable of associating with material to be dispersed. Examples of suitable dispersants include oil soluble polymeric hydrocarbyl backbones each having one or more functional groups which are capable of associating with particles to be dispersed. The functional groups may be amine, alcohol, amine-alcohol, amide or ester groups. The functional groups may be attached to the hydrocarbyl backbone through bridging groups. More than one dispersant may be present in the additive concentrate and/or lubricant composition.

Examples of suitable ashless dispersants include oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; Mannich condensation products formed by condensing a long chain substituted phenol with formaldehyde and polyalkylene polyamine; Koch reaction products and the like. Examples of suitable dispersants include derivatives of long chain hydrocarbyl-substituted carboxylic acids, for example in which the hydrocarbyl group has a number average molecular weight of up to 20000, for example 300 to 20000, 500 to 10000, 700 to 5000 or less than 15000. Examples of suitable dispersants include hydrocarbyl-substituted succinic acid compounds, for example succinimide, succinate esters or succinate ester amides and in particular, polyisobutenyl succinimide dispersants. The dispersants may be borated or non-borated. A suitable dispersant is ADX 222.

Dispersant Viscosity Modifiers.

Additionally or alternatively, dispersancy may be provided by polymeric compounds capable of providing viscosity index improving properties and dispersancy. Such compounds are generally known as dispersant viscosity improver additives or multifunctional viscosity improvers. Examples of suitable dispersant viscosity modifiers may be prepared by chemically attaching functional moieties (for example amines, alcohols and amides) to polymers which tend to have number average molecular weights of at least 15000, for example in the range 20000 to 600000 (for example as determined by gel permeation chromatography or light scattering methods). Examples of suitable dispersant viscosity modifiers and methods of making them are described in WO 99/21902, WO2003/099890 and WO2006/099250. More than one dispersant viscosity modifier may be present in the additive concentrate and/or lubricant composition.

Detergents

Detergents (also called detergent additives) may help reduce high temperature deposit formation for example on pistons in internal combustion engines, including for example high-temperature varnish and lacquer deposits, by helping to keep finely divided solids in suspension in the lubricant composition. Detergents may also have acid-neutralising properties. Ashless (that is non-metal containing detergents) may be present. Metal-containing detergent comprises at least one metal salt of at least one organic acid, which is called soap or surfactant. Detergents may be overbased in which the detergent comprises an excess of metal in relation to the stoichiometric amount required to neutralise the organic acid. The excess metal is usually in the form of a colloidal dispersion of metal carbonate and/or hydroxide. Examples of suitable metals include Group I and Group 2 metals, more suitably calcium, magnesium and combinations thereof, especially calcium. More than one metal may be present.

Examples of suitable organic acids include sulphonic acids, phenols (sulphurised or preferably sulphurised and including for example, phenols with more than one hydroxyl group, phenols with fused aromatic rings, phenols which have been modified for example alkylene bridged phenols, and Mannich base-condensed phenols and saligenin-type phenols, produced for example by reaction of phenol and an aldehyde under basic conditions) and sulphurised derivatives thereof, and carboxylic acids including for example, aromatic carboxylic acids (for example hydrocarbyl-substituted salicylic acids and sulphurised derivatives thereof, for example hydrocarbyl substituted salicylic acid and derivatives thereof). More than one type of organic acid may be present.

Additionally or alternatively, non-metallic detergents may be present. Suitable non-metallic detergents are described for example in U.S. Pat. No. 7,622,431.

More than one detergent may be present in the lubricant composition and/or additive concentrate.

Viscosity Index Improvers/Viscosity Modifiers

Viscosity index improvers (also called viscosity modifiers, viscosity improvers or VI improvers) impart high and low temperature operability to a lubricant composition and facilitate it remaining shear stable at elevated temperatures whilst also exhibiting acceptable viscosity and fluidity at low temperatures.

Examples of suitable viscosity modifiers include high molecular weight hydrocarbon polymers (for example polyisobutylene, copolymers of ethylene and propylene and higher alpha-olefins); polyesters (for example polymethacrylates); hydrogenated poly(styrene-co-butadiene or isoprene) polymers and modifications (for example star polymers); and esterified poly(styrene-co-maleic anhydride) polymers. Oil-soluble viscosity modifying polymers generally have number average molecular weights of at least 15000 to 1000000, preferably 20000 to 600000 as determined by gel permeation chromatography or light scattering methods.

Viscosity modifiers may have additional functions as multifunction viscosity modifiers. More than one viscosity index improver may be present.

Pour Point Depressants

Pour point depressants (also called lube oil improvers or lube oil flow improvers), lower the minimum temperature at which the lubricant will flow and can be poured. Examples of suitable pour point depressants include $C_8$ to $C_{18}$ dialkyl fumarate/vinyl acetate copolymers, methacrylates, polyacrylates, polyarylamides, polymethacrylates, polyalkyl methacrylates, vinyl fumarates, styrene esters, condensation products of haloparaffin waxes and aromatic compounds, vinyl carboxylate polymers, terpolymers of dialkyfumarates, vinyl esters of fatty acids and allyl vinyl ethers, wax naphthalene and the like.

More than one pour point depressant may be present.

Rust Inhibitors

Rust inhibitors generally protect lubricated metal surfaces against chemical attack by water or other contaminants. Examples of suitable rust inhibitors include non-ionic polyoxyalkylene polyols and esters thereof, polyoxyalkylene phenols, polyoxyalkylene polyols, anionic alky sulphonic acids, zinc dithiophosphates, metal phenolates, basic metal sulphonates, fatty acids and amines.

More than one rust inhibitor may be present.

Corrosion Inhibitors

Corrosion inhibitors (also called anti-corrosive agents) reduce the degradation of metallic parts contacted with the lubricant composition. Examples of corrosion inhibitors include phosphosulphurised hydrocarbons and the products obtained by the reaction of phosphosulphurised hydrocarbon with an alkaline earth metal oxide or hydroxide, non-ionic polyoxyalkylene polyols and esters thereof, polyoxyalkylene phenols, thiadiazoles, triazoles and anionic alkyl sulphonic acids. Examples of suitable epoxidised ester corrosion inhibitors are described in US2006/0090393.

More than one corrosion inhibitor may be present.

Antioxidants

Antioxidants (sometimes also called oxidation inhibitors) reduce the tendency of oils to deteriorate in use. Evidence of such deterioration might include for example the production of varnish-like deposits on metal surfaces, the formation of sludge and viscosity increase. ZDDP's exhibit some antioxidant properties.

Examples of suitable antioxidants other than ZDDP's include alkylated diphenylamines, N-alkylated phenylenediamines, phenyl-α-naphthylamine, alkylated phenyl-α-naphthylamines, dimethylquinolines, trimethyldihydroquinolines and oligomeric compositions derived therefrom, hindered phenolics (including ashless (metal-free) phenolic compounds and neutral and basic metal salts of certain phenolic compounds), aromatic amines (including alkylated and non-alkylated aromatic amines), sulphurised alkyl phenols and alkali and alkaline earth metal salts thereof, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds (for example, copper dihydrocarbyl thio- or thiophosphate, copper salts of a synthetic or natural carboxylic acids, for example a $C_8$ to $C_{18}$ fatty acid, an unsaturated acid or a branched carboxylic acid, for example basic, neutral or acidic $Cu^{I}$ and/or $Cu^{II}$ salts derived from alkenyl succinic acids or anhydrides), alkaline earth metal salts of alkylphenolthioesters, suitably having $C_5$ to $C_{12}$ alkyl side chains, calcium nonylphenol sulphide, barium t-octylphenyl sulphide, dioctylphenylamine, phosphosulphised or sulphurised hydrocarbons, oil soluble phenates, oil soluble sulphurised phenates, calcium dodecylphenol sulphide, phosphosulphurised hydrocarbons, sulphurised hydrocarbons, phosphorus esters, low sulphur peroxide decomposers and the like.

More than one anti oxidant may be present. More than one type of anti oxidant may be present.

Antifoams

Anti-foams (sometimes also called anti-foaming agents) retard the formation of stable foams. Examples of suitable anti-foam agents include silicones, organic polymers, siloxanes (including poly siloxanes and (poly) dimethyl siloxanes, phenyl methyl siloxanes), acrylates and the like.

More than one anti-foam may be present.

Seal Swell Agents

Seal swell agents (sometimes also called seal compatibility agents or elastomer compatibility aids) help to swell elastomeric seals for example by causing a reaction in the fluid or a physical change in the elastomer. Examples of suitable seal swell agents include long chain organic acids, organic phosphates, aromatic esters, aromatic hydrocarbons, esters (for example butylbenzyl phthalate) and polybutenyl succinic anhydride.

More than one seal swell agent may be present.

Other Additives

Examples of other additives which may be present in the lubricant composition and/or additive concentrate include extreme pressure additives (including metallic, non-metallic, phosphorus containing, non-phosphorus containing, sulphur containing and non-sulphur containing extreme pressure additives), surfactants, demulsifiers, anti-seizure agents, wax modifiers, lubricity agents, anti-staining agents, chromophoric agents and metal deactivators.

Some additives may exhibit more than one function.

The amount of demulsifier, if present, might be higher than in conventional lubricants to off-set any emulsifying effect of the mono-, di-, or tri-glyceride additive.

Solvent

The additive concentrate for a lubricant composition may comprise solvent. Examples of suitable solvents include highly aromatic, low viscosity base stocks, for example 100N, 60 N and 100SP base stocks.

The representative suitable and more suitable independent amounts of additives (if present) in the lubricant composition are given in Table 2. The concentrations expressed in Table 2 are by weight of active additive compounds that is, independent of any solvent or diluent.

More than one of each type of additive may be present. Within each type of additive, more than one class of that type of additive may be present. More than one additive of each class of additive may be present. Additives may suitably be supplied by manufacturers and suppliers in solvent or diluents.

TABLE 2

| | Lubricant Composition | |
|---|---|---|
| ADDITIVE TYPE | Suitable amount (actives), if present (by weight) | More suitable amount (actives), if present (by weight) |
| Oil-soluble mono-, di-, or tri-glyceride of at least one hydroxy polycarboxylic acid, or a derivative thereof | 0.02 to 5% | 0.1 to 2.5% |
| Phosphorus-containing anti-wear additives | corresponding to 10 to 6000 ppm P | corresponding to 10 to 1000 ppm P |
| Molybdenum-containing anti-wear additives | corresponding to 10 to 1000 ppm Mo | corresponding to 40 to 600 ppm Mo |
| Boron-containing anti-wear additives | corresponding to 10 to 250 ppm B | corresponding to 50 to 100 ppm B |
| Friction modifiers other than the mono-, di-, or tri-glyceride of at least one hydroxy polycarboxylic acid, or a derivative thereof | 0.01 to 5% | 0.01 to 1.5% |
| Molybdenum-containing friction modifiers | corresponding to 10 to 1000 ppm Mo | corresponding to 400 to 600 ppm Mo |

TABLE 2-continued

| ADDITIVE TYPE | Lubricant Composition: Suitable amount (actives), if present (by weight) | Lubricant Composition: More suitable amount (actives), if present (by weight) |
|---|---|---|
| Dispersants | 0.1 to 20% | 0.1 to 8% |
| Detergents | 0.01 to 6% | 0.01 to 4% |
| Viscosity index improvers | 0.01 to 20% | 0.01 to 15% |
| Pour point depressants | 0.01 to 5% | 0.01 to 1.5% |
| Corrosion and/or rust inhibitors | 0.01 to 5% | 0.01 to 1.5% |
| Anti-oxidants | 0.1 to 10% | 0.5 to 5% |
| Antifoams containing silicon | corresponding to 1 to 20 ppm Si | corresponding to 1 to 10 ppm Si |

Lubricant Applications.

The mono-, di-, or tri-glyceride of at least one hydroxy polycarboxylic acid or a derivative may be used as an anti-wear additive and/or friction modifier in a non-aqueous lubricant composition and/or in a fuel composition.

The oil-soluble mono-, di-, or tri-glyceride of at least one hydroxy polycarboxylic acid, or a derivative thereof may be used as an anti-wear additive and/or friction modifier in a lubricant composition which is a functional fluid, for example a metalworking fluid which may be used to lubricate metals during machining, rolling and the like. Suitably, the lubricant composition is a lubricant composition according to the present invention.

The oil-soluble mono-, di-, or tri-glyceride of at least one hydroxy polycarboxylic acid, or a derivative thereof may be used as an anti-wear additive and/or friction modifier in a lubricant composition which is a power transmission fluid for example as an automatic transmission fluid, a fluid in a clutch (for example a dual clutch), a gear lubricant, or in other automotive applications and the like. Suitably, the lubricant composition is a lubricant composition according to the present invention. The additive and lubricant composition may suitably be used in aviation lubricant applications.

The mono-, di-, or tri-glyceride of at least one hydroxy polycarboxylic acid or a derivative may be used as an anti-wear additive and/or friction modifier in a non-aqueous lubricant composition and/or in a fuel composition used to lubricate a solid surface, including for example metallic surfaces and non-metallic surfaces. Suitable metallic surfaces include surfaces of ferrous based materials, for example cast iron and steels; surfaces of aluminium-based solids, for example aluminium-silicon alloys; surfaces of metal matrix compositions; surfaces of copper and copper alloys; surfaces of lead and lead alloys; surfaces of zinc and zinc alloys; and surfaces of chromium-plated materials. Suitable non-metallic surfaces include surfaces of ceramic materials; surfaces of polymer materials; surfaces of carbon-based materials; and surfaces of glass. Other surfaces which may be lubricated include surfaces of coated materials for example surfaces of hybrid materials for example metallic materials coated with non-metallic materials and non-metallic materials coated with metallic materials; surfaces of diamond-like carbon coated materials and SUMEBore™ materials for example as described in Sultzer technical review April/2009 pages 11-13.

The glyceride may be used in a non-aqueous lubricant composition and/or in a fuel composition to lubricate a surface at any typical temperature which might be encountered in a lubricating environment, for example at a temperature such as may be encountered in an internal combustion engine, for example a temperature in the range of ambient to 250° C., e.g. 90 to 120° C. Typically ambient temperature may be 20° C., but may be less than 20° C., for example 0° C.

Internal Combustion Engine Lubrication.

The oil-soluble mono-, di-, or tri-glyceride of at least one hydroxy polycarboxylic acid, or a derivative thereof may be used as an anti-wear additive and/or friction modifier in a lubricant composition which may be used to lubricate an internal combustion engine, for example as a crankcase lubricant. The engine may be a spark-ignition, internal combustion engine, or a compression-ignition, internal combustion engine. The internal combustion engine may be a spark-ignition internal combustion engine used in automotive or aviation applications. The internal combustion engine may be a two-stroke compression-ignition engine and the oil-soluble mono-, di-, or tri-glyceride of at least one hydroxy polycarboxylic acid, or a derivative thereof may be used as an anti-wear additive and/or friction modifier in a system oil lubricant composition and/or a cylinder oil lubricant composition used to lubricate the engine. The two-stroke compression-ignition engine may be used in marine applications.

In the method of lubricating an internal combustion engine according to the present invention, the mono-, di- or tri-glyceride of at least one hydroxy polycarboxylic acid or derivative thereof may be present in a lubricant composition used to lubricate the engine, for example to lubricate the crankcase of the engine. Suitably, such a lubricant composition is a lubricant composition according to the present invention.

The mono-, di- or tri-glyceride of at least one hydroxy polycarboxylic acid, or derivative thereof may be added to the lubricant composition used to the lubricate the engine by slow release of the additive into the lubricant—for example by contacting the lubricant composition with a gel comprising the additive, for example as described in U.S. Pat. No. 6,843,916 and international PCT patent application publication WO 2008/008864 and/or by controlled release of the additive, for example when the back pressure of lubricant passing through a filter exceeds a define back pressure, for example as described in international PCT patent application publication WO2007/148047.

Additionally, or alternatively the mono-, di- or tri-glyceride of at least one hydroxyl polycarboxylic acid, or a derivative thereof may be present in the fuel for an internal combustion engine. In use, the diglyceride additive may pass with or without fuel into a lubricant composition used to lubricate the engine, for example as a crankcase lubricant and thereby provide antiwear and/or friction modifier benefits to the engine.

Thus according to a further aspect of the present invention, there is provided a fuel composition for an internal combustion engine which composition comprises a major amount of a liquid fuel and a minor amount of at least one additive which is an oil-soluble mono-, di-, or tri-glyceride of at least one hydroxy polycarboxylic acid, or a derivative thereof.

The engine may be a spark-ignition, internal combustion engine, or a compression-ignition, internal combustion engine. The engine may be a homogeneous charge compression ignition internal combustion engine. The internal combustion engine may be a spark-ignition internal combustion engine used in automotive or aviation applications. The internal combustion engine may be a two-stroke compression-ignition engine. The two-stroke compression-ignition engine may be used in marine applications.

The mono-, di- or tri-glyceride of at least one hydroxy polycarboxylic acid, or a derivative thereof is present in the fuel at a concentration of up to 500 ppm by weight, for example 20 to 200 ppm by weight or 50 to 100 ppm by weight.

Typically, the rate of ingress of fuel into crankcase lubricant is higher for spark-ignition internal combustion engines than for compression-ignition engines. However, the rate at which fuel ingresses into the crankcase lubricant for compression-ignition engines may depend and may increase depending upon the use of post-injection strategies for operation of the engine.

The mono-, di- or tri-glyceride of at least one hydroxy polycarboxylic acid, or a derivative thereof, present in the fuel composition may reduce wear in the fuel system of the engine, for example the fuel pump.

Fuels

Suitable liquid fuels, particularly for internal combustion engines include hydrocarbon fuels, oxygenate fuels and combinations thereof. Hydrocarbon fuels may be derived from mineral sources and/or from renewable sources such as biomass (e.g.

biomass-to-liquid sources) and/or from gas-to-liquid sources and/or from coal-to-liquid sources. Suitable sources of biomass include sugar (e.g. sugar to diesel fuel) and algae. Suitable oxygenate fuels include alcohols for example, straight and/or branched chain alkyl alcohols having from 1 to 6 carbon atoms, esters for example, fatty acid alkyl esters and ethers, for example methyl tert butyl ether. Suitable fuels may also include LPG-diesel fuels (LPG being liquefied petroleum gas). The fuel composition may be an emulsion. However, suitably, the fuel composition is not an emulsion.

Suitable fatty acid alkyl esters include methyl, ethyl, propyl, butyl and hexyl esters. Usually, the fatty acid alkyl ester is a fatty acid methyl ester. The fatty acid alkyl ester may have 8 to 25 carbon atoms, suitably, 12 to 25 carbon atoms, for example 16 to 18 carbon atoms. The fatty acid may be saturated or unsaturated. Usually, the fatty acid alkyl ester is acyclic. Fatty acid alkyl esters may be prepared by esterification of one or more fatty acids and/or by transesterification of one or more triglycerides of fatty acids. The triglycerides may be obtained from vegetable oils, for example, castor oil, soyabean oil, cottonseed oil, sunflower oil, rapeseed oil (which is sometimes called canola oil), Jatropha oil or palm oil, or obtained from tallow (for example sheep and/or beef tallow), fish oil or used cooking oil. Suitable fatty acid alkyl esters include rapeseed oil methyl ester (RME), soya methyl ester or combinations thereof.

The fuel composition according to the present invention may be prepared by admixing in one or more steps a hydrocarbon fuel, an oxygenate fuel or a combination thereof with an effective amount of at least one additive which is a mono-, di- or tri-glyceride of at least one hydroxy polycarboxylic acid, or a derivative thereof and optionally at least one other fuel additive.

The method of preparing a fuel composition and the method of improving the antiwear and/or friction properties of a liquid fuel comprise admixing in one or more steps said liquid fuel (which may be for example a hydrocarbon fuel, an oxygenate fuel or a combination thereof) with an effective amount of at least one additive which is a mono-, di- or tri-glyceride of at least one hydroxy polycarboxylic acid, or a derivative thereof and optionally at least one other fuel additive.

The fuel may be admixed with at least one additive in one or more steps by methods known in the art. The additives may be admixed as one or more additive concentrates or part additive package concentrates, optionally comprising solvent or diluent. The hydrocarbon fuel, oxygenate fuel or combination thereof may be prepared by admixing in one or more steps by methods known in the art, one or more base fuels and components therefor, optionally with one or more additives and/or part additive package concentrates. The additives, additive concentrates and/or part additive package concentrates may be admixed with the fuel or components therefor in one or more steps by methods known in the art.

Fuels and Concentrates For Compression-ignition Engines.

The fuel composition of the present invention may be suitable for use in an internal combustion engine which is a compression-ignition internal combustion engine, suitably a direct injection diesel engine, for example of the rotary pump, in-line pump, unit pump, electronic unit injector or common rail type, or in an indirect injection diesel engine. The fuel composition may be suitable for use in heavy and/or light duty diesel engines.

The fuel composition for compression-ignition internal combustion engines may have a sulphur content of up to 500 ppm by weight, for example, up to 15 ppm by weight or up to 10 ppm by weight. The fuel composition for compression-ignition internal combustion engines may meet the requirements of the EN590 standard, for example as set out in BS EN 590:2009.

Suitable oxygenate components in the fuel composition for compression-ignition internal combustion engines include fatty acid alkyl esters, for example fatty acid methyl esters. The fuel may comprise one or more fatty acid methyl esters complying with EN 14214 at a concentration of up to 7% by volume. Oxidation stability enhancers may be present in the fuel composition comprising one or more fatty acid alkyl or methyl esters, for example at a concentration providing an action similar to that obtained with 1000 mg/kg of 3,5-di-tert-butyl-4-hydroxy-toluol (also called butylated hydroxyl-toluene or BHT). Dyes and/or markers may be present in the fuel composition for compression-ignition internal combustion engines.

The fuel composition for compression-ignition internal combustion engines may have one or more of the following, for example, as defined according to BS EN 590:2009:—a minimum cetane number of 51.0, a minimum cetane index of 46.0, a density at 15° C. of 820.0 to 845.0 kg/m$^3$, a maximum polycyclic aromatic content of 8.0% by weight, a flash point above 55° C., a maximum carbon residue (on 10% distillation) of 0.30% by weight, a maximum water content of 200 mg/kg, a maximum contamination of 24 mg/kg, a classl copper strip corrosion (3 h at 50° C.), a minimum oxidation stability limit of 20 h according to EN 15751 and a maximum oxidation stability limit of 25 g/m$^3$ according to EN ISO 12205, a maximum limit for lubricity corrected wear scar diameter at 60° C. of 460 μm, a minimum viscosity at 40° C. of 2.00 mm$^2$/s and a maximum viscosity at 40° C. of 4.50 mm$^2$/s, <65% by volume distillation recovery at 250° C., a minimum distillation recovery at 350° C. of 85% by volume and a maximum of 95% by volume recovery at 360° C.

The fuel composition and the additive concentrate for a fuel composition suitable for use in a compression-ignition internal combustion engine may further comprise at least one friction modifier other than the additive which is a mono-, di- or tri-glyceride of at least one hydroxy polycarboxylic acid, or a derivative thereof. Such other friction modifiers include compounds described herein as friction modifiers for lubricant compositions and additive concentrates for lubricant compositions.

The fuel composition and the additive concentrate for a fuel composition suitable for use with a compression-ignition internal combustion engine may further comprise at least one lubricity additive. Suitable lubricity additives include tall oil fatty acids, mono- and di-basic acids and esters.

The fuel composition and the additive concentrate for a fuel composition suitable for use in a compression-ignition internal combustion engine may further comprise independently one or more cetane improver, one or more detergent, one or more anti-oxidant, one or more anti-foam, one or more demulsifier, one or more cold flow improver, one or more pour point depressant, one or more biocide, one or more odorant, one or more colorant (sometimes called dyes), one or more marker, one or more spark aiders and/or combinations of one or more thereof. Other suitable additives which may be present include thermal stabilizers, metal deactivators, corrosion inhibitors, antistatic additives, drag reducing agents, emulsifiers, dehazers, anti-icing additives, antiknock additives, anti-valve-seat recession additives, surfactants and combustion improvers, for example as described in EP-2107102-A.

The additive concentrate for a fuel composition for a compression-ignition internal combustion engine may comprise solvent. Suitable solvents include carrier oils (for example mineral oils), polyethers (which may be capped or uncapped), non-polar solvents (for example toluene, xylene, white spirits and those sold by Shell companies under the trade mark "SHELLSOL"), and polar solvents (for example esters and alcohols e.g. hexanol, 2-ethylhexanol, decanol, isotridecanol and alcohol mixtures, for example those sold by Shell companies under the trade mark "LINEVOL", e.g. LINEVOL 79 alcohol which is a mixture of $C_{7-9}$ primary alcohols, or a $C_{12-14}$ alcohol mixture which is commercially available.

Suitable cetane improvers include 2-ethyl hexyl nitrate, cyclohexyl nitrate and di-tert-butyl peroxide. Suitable anti-foams include siloxanes. Suitable detergents include polyolefin substituted succinimides and succinamides of polyamines, for example polyisobutylene succinimides, polyisobutylene amine succinimides, aliphatic amines, Mannich bases and amines and polyolefin (e.g. polyisobutylene) maleic anhydride. Suitable antioxidants include phenolic antioxidants (for example 2,6-di-tert-butylphenol) and aminic antioxidants (for example N,N'-di-sec-butyl-p-phenylenediamine). Suitable anti-foaming agents include polyether-modified polysiloxanes.

The representative suitable and more suitable independent amounts of additives (if present) in the fuel composition suitable for a compression-ignition engine are given in Table 3. The concentrations expressed in Table 3 are by weight of active additive compounds that is, independent of any solvent or diluent.

The additives in the fuel composition suitable for use in compression-ignition internal combustion engines are suitably present in a total amount in the range of 100 to 1500 ppm by weight. Therefore, the concentrations of each additive in an additive concentrate will be correspondingly higher than in the fuel composition, for example by a ratio of 1:0.0002 to 0.0015. The additives may be used as part-packs, for example part of the additives (sometimes called refinery additives) being added at the refinery during manufacture of a fungible fuel and part of the additives (sometimes called terminal or marketing additives) being added at a terminal or distribution point. The at least one additive which is a mono-, di- or tri-glyceride of at least one hydroxy polycarboxylic acid, or a derivative thereof may suitably be added or used as a refinery or marketing additive, preferably as a marketing additive for example at a terminal or distribution point.

TABLE 3

| | Fuel composition for compression-ignition internal combustion engine | |
|---|---|---|
| Additive type | Suitable amount (actives), if present (ppm by weight) | More suitable amount (actives), if present (ppm by weight) |
| Oil-soluble mono-, di-, or tri-glyceride of at least one hydroxy polycarboxylic acid, or a derivative thereof | 20 to 500 | 20 to 200 |
| Lubricity additives | 1 to 200 | 50 to 200 |
| Cetane improvers | 50 to 2000 | 100 to 1200 |
| Detergents | 20 to 300 | 50 to 200 |
| Anti-oxidants | 1 to 100 | 2 to 50 |
| Anti foams | 1 to 50 | 5 to 20 |
| Demulsifiers | 1 to 50 | 5 to 25 |
| Cold flow improvers | 10 to 500 | 50 to 100 |

Fuels and Concentrates For Spark-ignition Engines.

The fuel composition of the present invention may be suitable for use in an internal combustion engine which is a spark-ignition internal combustion engine.

The fuel composition for spark-ignition internal combustion engines may have a sulphur content of up to 50.0 ppm by weight, for example up to 10.0 ppm by weight.

The fuel composition for spark-ignition internal combustion engines may be leaded or unleaded.

The fuel composition for spark-ignition internal combustion engines may meet the requirements of EN 228, for example as set out in BS EN 228:2008. The fuel composition for spark-ignition internal combustion engines may meet the requirements of ASTM D 4814-09b.

The fuel composition for spark-ignition internal combustion engines may have one or more of the following, for example, as defined according to BS EN 228:2008:—a minimum research octane number of 95.0, a minimum motor octane number of 85.0 a maximum lead content of 5.0 mg/l, a density of 720.0 to 775.0 kg/m$^3$, an oxidation stability of at least 360 minutes, a maximum existent gum content (solvent washed) of 5 mg/100 ml, a class 1 copper strip corrosion (3 h at 50° C.), clear and bright appearance, a maximum olefin content of 18.0% by weight, a maximum aromatics content of 35.0% by weight, and a maximum benzene content of 1.00% by volume.

Suitable oxygenate components in the fuel composition for spark-ignition internal combustion engines include straight and/or branched chain alkyl alcohols having from 1 to 6 carbon atoms, for example methanol, ethanol, n-propanol, n-butanol, isobutanol, tert-butanol. Suitable oxygenate components in the fuel composition for spark-ignition internal combustion engines include ethers, for example having 5 or more carbon atoms. The fuel composition may have a maximum oxygen content of 2.7% by mass. The fuel composition may have maximum amounts of oxygenates as specified in EN 228, for example methanol: 3.0% by volume, ethanol: 5.0% by volume, iso-propanol: 10.0% by volume, iso-butyl alcohol: 10.0% by volume, tert-butanol: 7.0% by volume, ethers ($C_5$ or higher): 10% by volume and other oxygenates (subject to suitable final boiling point): 10.0% by volume. The fuel composition may comprise ethanol complying with EN 15376 at a concentration of up to 5.0% by volume.

The fuel composition and the additive concentrate for a fuel composition suitable for use in a spark-ignition internal combustion engine may further comprise at least one friction modifier other than the additive which is a mono-, di- or tri-glyceride of at least one hydroxy polycarboxylic acid, or a derivative thereof. Such other friction modifiers include compounds described herein as friction modifiers for lubricant compositions and additive concentrates for lubricant compositions.

The fuel composition and the additive concentrate for a fuel composition suitable for use in a spark-ignition internal combustion engine may further comprise independently one or more detergent, one or more octane improver, one or more friction modifier, one or more anti-oxidant, one or more valve seat recession additive, one or more corrosion inhibitor, one or more anti-static agent, one or more odorant, one or more colorant, one or more marker and/or combinations of one or more thereof.

The additive concentrate for a fuel composition for a spark-ignition internal combustion engine may comprise solvent. Suitable solvents include polyethers and aromatic and/or aliphatic hydrocarbons, for example heavy naphtha e.g. Solvesso (Trade mark), xylenes and kerosine.

Suitable detergents include poly isobutylene amines (PIB amines) and polyether amines.

Suitable octane improvers include N-methyl aniline, methyl cyclopentadienyl manganese tricarbonyl (MMT) (for example present at a concentration of up to 120 ppm by weight), ferrocene (for example present at a concentration of up to 16 ppm by weight) and tetra ethyl lead (for example present at a concentration of up to 0.7 g/l e.g. up to 0.15 g/l).

Suitable anti-oxidants include phenolic anti-oxidants (for example 2,4-di-tert-butylphenol and 3,5-di-tert-butyl-4-hydroxyphenylpropionic acid) and aminic anti-oxidants (for example para-phenylenediamine, dicyclohexylamine and derivatives thereof).

Suitable corrosion inhibitors include ammonium salts of organic carboxylic acids, amines and heterocyclic aromatics, for example alkylamines, imidazolines and tolyltriazoles.

Valve seat recession additives may be present at a concentration of up to 15000 ppm by weight, for example up to 7500 ppm by weight.

The representative suitable and more suitable independent amounts of additives (if present) in the fuel composition suitable for a spark-ignition engine are given in Table 4. The concentrations expressed in Table 4 are by weight of active additive compounds that is, independent of any solvent or diluent.

The additives in the fuel composition suitable for use in spark-ignition internal combustion engines are suitably present in a total amount in the range of 20 to 25000 ppm by weight. Therefore, the concentrations of each additive in an additive concentrate will be correspondingly higher than in the fuel composition, for example by a ratio of 1:0.00002 to 0.025. The additives may be used as part-packs, for example part of the additives (sometimes called refinery additives) being added at the refinery during manufacture of a fungible fuel and part of the additives (sometimes called terminal or marketing additives) being added at a terminal of distribution point. The at least one additive which is a mono-, di- or tri-glyceride of at least one hydroxy polycarboxylic acid, or a derivative thereof may suitably be added or used as a refinery or marketing additive, preferably as a marketing additive for example at a terminal or distribution point.

TABLE 4

| Additive type | Fuel composition for spark-ignition internal combustion engine: Suitable amount (actives), if present (ppm by weight) | More suitable amount (actives), if present (ppm by weight) |
|---|---|---|
| Oil-soluble mono-, di-, or tri-glyceride of at least one hydroxy polycarboxylic acid, or a derivative thereof | 20 to 500 | 20 to 200 |
| Friction modifiers other than mono-, di-, or tri-glyceride of at least one hydroxy polycarboxylic acid, or a derivative thereof | 10 to 500 | 25 to 150 |
| Detergents | 10 to 2000 | 50 to 300 |
| Octane improvers | 50 to 20000 | |
| Anti-oxidants | 1 to 100 | 10 to 50 |
| Anti-static agents | 0.1 to 5 | 0.5 to 2 |

The invention will now be described by way of example only with reference to the following experiments and examples in which examples according to the present invention are labelled numerically as Example 1, Example 2 etc. and experiments not according to the present invention are labelled alphabetically as Experiment A, Experiment B etc.

Preparation of Lubricant Compositions.

A 5W-30 lubricant composition (Lubricant A) was prepared to model a typical lubricant composition suitable for passenger cars with either compression-ignition or spark-ignition internal combustion engines, but having a lower ZDDP content than a typical lubricant. The lubricant composition was made by admixing additives as in a commercially available additive package containing dispersant, detergent, antioxidant, antifoam and ZDDP (but with reduced amount of ZDDP) with a Group III base oil, a pour point depressant, viscosity modifier and dispersant viscosity modifier.

A lubricant composition (Lubricant 1) according to the present invention was prepared in the same way as Lubricant A but with 1.2% by weight Citrem SP 70 (Trade Mark) (a diglyceride of citric acid and oleic/linoleic acid).

Several other lubricant compositions (Lubricants B to D) were prepared as Lubricant 1 but with friction modifiers/anti-wear additives other than Citrem SP70 as indicated below. Thus, Lubricant B used glycerol monooleate (HiTEC® 7133), Lubricant C used triethyl citrate and Lubricant D used Sakura-lube 165, the active component of which is which is molybdenum dithiocarbamate (MoDTC).

Lubricants A to D are not according to the present invention because the lubricant compositions do not contain any mono-, di-, or tri-glyceride of at least one hydroxy polycarboxylic acid, or a derivative thereof. Lubricant 1 is according to the present invention.

All the lubricant compositions had a ZDDP content corresponding to 0.0285% by weight phosphorus.

1. Wear Testing of Lubricant Compositions.

Thin layer activation (TLA) wear tests were undertaken for Lubricants A to D and Lubricant 1.

The TLA wear test is a radio nucleotide wear test used to simulate cam follower wear in an engine. Wearing components were radioactively activated and the rate at which radio-active metal was worn off and accumulated in the oil was measured to assess the wear in nm/h. The results for the tests performed at 40° C., are shown in Table 5. Experiments A to D are not according to the present invention because the lubricant compositions do not contain any mono-, di-, or tri-glyceride of at least one hydroxy polycarboxylic acid, or a derivative thereof. Example 1 is according to the present invention.

The results in Table 5 show that the mono-, di-, or tri-glyceride of at least one hydroxy polycarboxylic acid, or a derivative thereof and in particular a diglyceride of citric acid and an unsaturated $C_{18}$ carboxylic acid (e.g. oleic and/or linoleic acid), for example Citrem SP70 (trade mark), exhibits good anti-wear properties in a lubricant composition, for example when used in combination with a low concentration of zinc dihydrocarbyl dithiophosphates (ZDDP), for example corresponding to 285 ppm phosphorus.

TABLE 5

| | Lubricant | Anti-wear additive | Treat rate of anti-wear additive (wt. %) | Wear rate (nm/h) | Wear reduction compared to Experiment A |
|---|---|---|---|---|---|
| Expt. A | A | — | — | 98.9 | — |
| Example 1 | 1 | Citrem SP70 | 1.2% | 27.0 | 73.0% |
| Expt. B | B | Glycerol monooleate (GMO) | 0.5% | 39.6 | 60.0% |
| Expt. C | C | Triethyl citrate | 1% | 37.1 | 62.5% |
| Expt. D | D | Sakura-lube 165 | 1% (450 ppm Mo) | 28.7 | 71% |

2. Cameron Plint Wear Tests.

Cameron Plint wear tests were undertaken for lubricants with the same compositions as those used in the previously-described tests.

The Cameron Hint rig wear test was used to simulate reciprocating boundary friction and produce wear at higher temperatures (100° C.). The apparatus was set up in a pin on plate configuration. The pin was reciprocated along the plate at a frequency of 25 Hz, stroke length of 2.3 mm and with an applied pressure of 150N. Oil was fed into the contact area at a rate of 3 ml/hr. Standard steel B01 Flat Plate and EN31 Roller plint components were used in these tests. The results from 10 hour tests are shown in Table 6. Experiments E to H are not according to the present invention because the lubricant compositions do not contain any mono-, di-, or tri-glyceride of at least one hydroxy polycarboxylic acid, or a derivative thereof. Example 2 is according to the present invention.

TABLE 6

| | Lubricant | Anti-wear additive | Treat rate of anti-wear additive (wt. %) | Wear volume ($m^3$/Nm) | Wear reduction compared to Experiment E |
|---|---|---|---|---|---|
| Expt. E | A | — | — | $5.71 \times 10^{-17}$ | — |
| Example 2 | 1 | Citrem SP70 | 1.2% | $3.78 \times 10^{-18}$ | 93.7% |
| Expt. F | B | Glycerol monooleate (GMO) | 0.5% | $6.11615 \times 10^{-18}$ | 89.3% |
| Expt. G | C | Triethyl citrate | 1% | $2.96357 \times 10^{-18}$ | 94.8% |
| Expt. H | D | Sakura-lube 165 | 1% (450 ppm Mo) | $2.5002 \times 10^{-18}$ | 95.6% |

The results in Table 6 show that the mono-, di-, or tri-glyceride of at least one hydroxy polycarboxylic acid, or a derivative thereof and in particular a diglyceride of citric acid and an unsaturated $C_{18}$ carboxylic acid (e.g. oleic and/or linoleic acid), for example Citrem SP70 (trade mark), exhibits good anti-wear properties in a lubricant composition, for example when used in combination with a low concentration of zinc dihydrocarbyl dithiophosphates (ZDDP), for example corresponding to 285 ppm phosphorus.

3. Four-Ball Wear Tests.

Four-Ball wear tests according to ASTM D 4172 but modified to test mild and hence discriminating conditions of 30 kg and 60 minutes were undertaken for lubricants with the same compositions as those used in the previously-described tests. In the 4 ball wear test, one ball bearing was rotated above a cradle of three others in the presence of a lubricant. The results are shown in Table 7. Experiments I to L are not according to the present invention because the lubricant compositions do not contain any mono-, di-, or tri-glyceride of at least one hydroxy polycarboxylic acid or a derivative. Example 3 is according to the present invention.

TABLE 7

| | Lubricant Comp. | Anti-wear additive | Treat rate of anti-wear additive (wt. %) | Mean wear scar diameter (mm) | Wear reduction compared to Experiment I |
|---|---|---|---|---|---|
| Expt. I | A | — | — | 0.447 | — |
| Example 3 | 1 | Citrem SP70 | 1.2% | 0.321 | 28.2% |
| Expt. J | B | Glycerol mono-oleate (GMO) | 0.5% | 0.302 | 32.4% |
| Expt. K | C | Triethyl citrate | 1% | 0.346 | 22.6% |
| Expt. L | D | Sakura-lube 165 | 1% (450 ppm Mo) | 0.387 | 13.4% |

The results in Table 7 show that the mono-, di-, or tri-glyceride of at least one hydroxy polycarboxylic acid, or a derivative thereof and in particular a diglyceride of citric acid and an unsaturated $C_{18}$ carboxylic acid (e.g. oleic and/or linoleic acid), for example Citrem SP70 (trade mark), exhibits good anti-wear properties in a lubricant composition, for example when used in combination with a low concentration of zinc dihydrocarbyl dithiophosphates (ZDDP), for example corresponding to 285 ppm phosphorus.

4. HFRR Friction Tests.

A High Frequency Reciprocating Rig friction test was undertaken for lubricants with the same compositions as those used in the previously-described tests.

The HFRR test is usually used to assess lubricity of diesel fuels (according to ASTM D6079-97). It may also be used to assess friction coefficients between sliding solid surfaces in the presence of lubricant compositions with various friction modifiers over a temperature range and hence the test may be used to assess the performance of the friction modifiers.

The results are shown in Table 8. Experiments M to P are not according to the present invention because the lubricant compositions do not contain any mono-, di-, or tri-glyceride of at least one hydroxy polycarboxylic acid, or a derivative thereof. Example 4 is according to the present invention.

TABLE 8

| | Lubricant Comp. | FC 40° C. | FC 140° C. | Average FC | Reduction of average FC |
|---|---|---|---|---|---|
| Expt. M | A | 0.138 | 0.159 | 0.145 | — |
| Example 4 | 1 | 0.124 | 0.117 | 0.121 | 16.6% |
| Expt. N | B | 0.129 | 0.118 | 0.124 | 14.5% |
| Expt. O | C | 0.134 | 0.15 | 0.143 | 1.4% |
| Expt. P | D | 0.137 | 0.113 | 0.121 | 16.6% |

Note:
FC = friction coefficient

The results in Table 8 show that the mono-, di-, or tri-glyceride of at least one hydroxy polycarboxylic acid, or a derivative thereof and in particular a diglyceride of citric acid and oleic acid, for example Citrem SP70 (trade mark), exhibits good friction modifier properties in a lubricant composition, for example when used in combination with a low concentration of zinc dihydrocarbyl dithiophosphates (ZDDP), for example corresponding to 285 ppm phosphorus.

The results in Table 8 also indicate that the mono-, di-, or tri-glyceride of at least one hydroxy polycarboxylic acid, or a derivative thereof and in particular a diglyceride of citric acid and an unsaturated $C_{18}$ carboxylic acid (e.g. oleic and/or linoleic acid), for example Citrem SP70 (trade mark) may be used as a friction modifier in a fuel composition for an internal ignition engine, for example a fuel composition for a compression-ignition engine.

5. Sequence IVA Engine Wear Tests.

Sequence IVA engine tests according to ASTM test method ASTM D6891 were undertaken for 0 W-20 lubricant compositions. The Sequence IVA test is an industry standard test used to evaluate the camshaft wear protection of internal combustion engine lubricant compositions.

The lubricants contained an additive package comprising dispersant, detergents (calcium sulphonate and phenate), antioxidants (phenolic and aminic), anti-foam and a Yubase 4 diluent. The additive package was typical of that used for standard lubricant compositions for internal combustion engines of the compression-ignition or spark-ignition type such as might be used for passenger cars. All but one of the lubricant compositions had a low concentration of zinc dihydrocarbyl dithiophosphates (ZDDP) corresponding to a phosphorus concentration of 375 ppm by weight. The lubricants were prepared by admixing the additive package, ZDDP, Group III base oil and the required anti-wear additive/friction modifier, if present.

Lubricants 2 and 3 used in Examples 5 and 6 were according to the present invention and were prepared using an oil-soluble mono-, di-, or tri-glyceride of at least one hydroxy polycarboxylic acid, or a derivative thereof which was Citrem SP 70 in an amount of 1.2% by weight and 0.5% by weight respectively.

Lubricant E was prepared as Lubricants 2 and 3 but without an oil-soluble mono-, di-, or tri-glyceride of at least one hydroxy polycarboxylic acid, or a derivative thereof.

Lubricant F was prepared as Lubricant E, but using a higher treat rate of ZDDP corresponding to 800 ppm of phosphorus.

Lubricants G to H were prepared as Lubricant E but using different anti-wear additive/friction modifiers as shown in Table 9.

Lubricants E, F and G used in Experiments Q, R and S respectively were not according to the present invention because they were prepared without an oil-soluble mono-, di-, or tri-glyceride of at least one hydroxy polycarboxylic acid, or a derivative thereof.

The lubricants had a low HTHS viscosity (according to ASTM D4683) of 2.6 cP and were of 0W-20 grade. The results are shown in Table 9.

TABLE 9

| | Lubricant composition | Additive | Treat rate % by weight | Average cam lobe wear (μm) |
|---|---|---|---|---|
| Expt. Q | E | — | — | 163.11 (2) |
| Expt. R | F (1) | — | | 62.4 (3) |
| Expt. S | G | Sakura-lube 165 | 0.9% (400 ppm Mo) | 18.44 |
| Example 5 | 2 | Citrem SP 70 | 1.2 | 10.44 |
| Example 6 | 3 | Citrem SP 70 | 0.5 | 12.28 |

Notes:
(1) 800 ppm P
(2) Re-measured 165.63 μm
(3) Re-measured 81.52 μm.

Iron concentrations in the lubricant compositions were measured during the tests and were found to correlate well with the measured wear results.

The results in Table 9 show that the mono-, di-, or tri-glyceride of at least one hydroxy polycarboxylic acid, or a derivative thereof and in particular a diglyceride of citric acid and an unsaturated $C_{18}$ carboxylic acid (e.g. oleic and/or linoleic acid), for example Citrem SP70 (trade mark), exhibits very good anti-wear properties in a lubricant composition, for example when used in combination with a low concentration of zinc dihydrocarbyl dithiophosphates (ZDDP), for example corresponding to 375 ppm phosphorus.

In particular, the results in Table 9 show that the mono-, di-, or tri-glyceride of at least one hydroxy polycarboxylic acid, or a derivative thereof and in particular a diglyceride of citric acid and an unsaturated $C_{18}$ carboxylic acid (e.g. oleic and/or linoleic acid), for example Citrem SP70 (trade mark) is more effective for example at a concentration of 0.5% (Example 6) than higher concentrations of MoDTC (Experiment S).

The results also show that reducing the amount of the mono-, di-, or tri-glyceride of at least one hydroxy polycarboxylic acid, or a derivative thereof and in particular a diglyceride of citric acid and an unsaturated $C_{18}$ carboxylic acid (e.g. oleic and/or linoleic acid), for example Citrem SP70 (trade mark) does not significantly reduce the anti-wear performance—compare for example, Examples 5 and 6.

6. M111-FE Engine Test

Lubricant G and Lubricant 2 were tested in an M111-FE engine test according to CEC-L-54-T-96 using a Mercedes Benz engine and found to have 3.32% fuel efficiency and 3.17% fuel efficiency respectively compared to the reference 15W-40 lubricant.

These results show that the mono-, di-, or tri-glyceride of at least one hydroxy polycarboxylic acid, or a derivative thereof and in particular a diglyceride of citric acid and an unsaturated $C_{18}$ carboxylic acid (e.g. oleic and/or linoleic acid), for example Citrem SP70 (trade mark), exhibits comparable friction modification with 400 ppm molybdenum provided by SK165, which is a molybdenum-containing additive commercially available from Asahi Denka Kogyo K.K.

The invention claimed is:

1. A non-aqueous lubricant composition comprising a major amount of an oil of lubricating viscosity and a minor amount of at least one additive which is an oil-soluble mono-, di-, or tri-glyceride of at least one hydroxy polycarboxylic acid, or a derivative of at least one hydroxy polycarboxylic acid together with more than one other lubricant additive.

2. The composition as claimed in claim 1 in which the hydroxy polycarboxylic acid has at least one hydroxy group which is in an alpha position with respect to a carboxylic moiety.

3. The composition as claimed in claim 2 in which the hydroxy polycarboxylic acid is citric acid.

4. The composition as claimed in claim 1 in which the glyceride is a glyceride of at least one hydroxy polycarboxylic acid and at least one second carboxylic acid which is a saturated, mono-unsaturated or poly-unsaturated, branched or linear, monocarboxylic or polycarboxylic acid having 4 to 22 carbon atoms, or a derivative thereof.

5. The composition as claimed in claim 2 in which the glyceride is a glyceride of at least one hydroxy polycarboxylic acid and at least one second carboxylic acid which is a saturated, mono-unsaturated or poly-unsaturated, branched or linear, monocarboxylic or polycarboxylic acid having 4 to 22 carbon atoms, or a derivative thereof.

6. The composition as claimed in claim 3 in which the glyceride is a glyceride of at least one hydroxy polycarboxylic acid and at least one second carboxylic acid which is a saturated, mono-unsaturated or poly-unsaturated, branched or linear, monocarboxylic or polycarboxylic acid having 4 to 22 carbon atoms, or a derivative thereof.

7. The composition as claimed in claim 1 in which the glyceride is a glyceride of at least one hydroxy polycarboxylic acid and a mono-unsaturated $C_4$ to $C_{22}$ monocarboxylic acid, or a derivative thereof.

8. The composition as claimed in claim 3 in which the glyceride is a glyceride of at least one hydroxy polycarboxylic acid and a mono-unsaturated $C_4$ to $C_{22}$ monocarboxylic acid, or a derivative thereof.

9. The composition as claimed in claim 3 in which the glyceride is a glyceride of at least one hydroxy polycarboxylic acid and a mono-unsaturated $C_4$ to $C_{22}$ monocarboxylic acid, or a derivative thereof.

10. The composition as claimed in claim 1 in which the glyceride is a glyceride of at least one hydroxy polycarboxylic acid and a polyunsaturated $C_4$ to $C_{22}$ monocarboxylic acid, or a derivative thereof.

11. The composition as claimed in claim 2 in which the glyceride is a glyceride of at least one hydroxy polycarboxylic acid and a polyunsaturated $C_4$ to $C_{22}$ monocarboxylic acid, or a derivative thereof.

12. The composition as claimed in claim 3 in which the glyceride is a glyceride of at least one hydroxy polycarboxylic acid and a polyunsaturated $C_4$ to $C_{22}$ monocarboxylic acid, or a derivative thereof.

13. The composition as claimed in claim 1 in which the glyceride is a glyceride of at least one hydroxy polycarboxylic acid and a mono-unsaturated or polyunsaturated $C_{18}$ monocarboxylic acid, or a derivative thereof.

14. The composition as claimed in claim 2 in which the glyceride is a glyceride of at least one hydroxy polycarboxylic acid and a mono-unsaturated or polyunsaturated $C_{18}$ monocarboxylic acid, or a derivative thereof.

15. The composition as claimed in claim 3 in which the glyceride is a glyceride of at least one hydroxy polycarboxylic acid and a mono-unsaturated or polyunsaturated $C_{18}$ monocarboxylic acid, or a derivative thereof.

16. The composition as claimed in claim 7 in which the mono-unsaturated $C_4$ to $C_{22}$ carboxylic acid is linear.

17. The composition as claimed in claim 8 in which the mono-unsaturated $C_4$ to $C_{22}$ carboxylic acid is linear.

18. The composition as claimed in claim 9 in which the mono-unsaturated $C_4$ to $C_{22}$ carboxylic acid is linear.

19. The composition as claimed in claim 10 in which the polyunsaturated $C_4$ to $C_{22}$ carboxylic acid is linear.

20. The composition as claimed in claim 11 in which the polyunsaturated $C_4$ to $C_{22}$ carboxylic acid is linear.

21. The composition as claimed in claim 12 in which the polyunsaturated $C_4$ to $C_{22}$ carboxylic acid is linear.

22. The composition as claimed in claim 1 in which the glyceride is a glyceride of citric acid and oleic acid, a glyceride of citric acid and linoleic acid or a mixture thereof.

23. The composition as claimed in claim 4 in which the carboxylic acid having 4 to 22 carbon atoms is a polycarboxylic acid and the derivative is an ester of a carboxylic acid moiety of said polycarboxylic acid.

24. The composition as claimed in claim 5 in which the carboxylic acid having 4 to 22 carbon atoms is a polycarboxylic acid and the derivative is an ester of a carboxylic acid moiety of said polycarboxylic acid.

25. The composition as claimed in claim 6 in which the carboxylic acid having 4 to 22 carbon atoms is a polycarboxylic acid and the derivative is an ester of a carboxylic acid moiety of said polycarboxylic acid.

26. The composition as claimed in claim 1 in which the derivative of the glyceride is an ether of the hydroxyl moiety of the hydroxy polycarboxylic acid.

27. The composition as claimed in claim 2 in which the derivative of the glyceride is an ether of the hydroxyl moiety of the hydroxy polycarboxylic acid.

28. The composition as claimed in claim 3 in which the derivative of the glyceride is an ether of the hydroxyl moiety of the hydroxy polycarboxylic acid.

29. The composition as claimed in claim 1 in which the derivative of the glyceride is an ester of the hydroxyl moiety of the hydroxy polycarboxylic acid.

30. The composition as claimed in claim 2 in which the derivative of the glyceride is an ester of the hydroxyl moiety of the hydroxy polycarboxylic acid.

31. The composition as claimed in claim 3 in which the derivative of the glyceride is an ester of the hydroxyl moiety of the hydroxy polycarboxylic acid.

32. The composition as claimed in claim 1 in which the derivative of the glyceride is an ester of a carboxylic acid moiety of the hydroxy polycarboxylic acid.

33. The composition as claimed in claim 2 in which the derivative of the glyceride is an ester of a carboxylic acid moiety of the hydroxy polycarboxylic acid.

34. The composition as claimed in claim 3 in which the derivative of the glyceride is an ester of a carboxylic acid moiety of the hydroxy polycarboxylic acid.

35. A non-aqueous lubricant composition as claimed in claim 1 in which the more than one other lubricant additive comprises at least one metallic or non-metallic detergent.

36. A non-aqueous lubricant composition as claimed in 35 in which the metallic detergent comprises at least one metal salt of at least one organic acid which is a carboxylic acid.

37. A non-aqueous lubricant composition as claimed in claim 36 in which the carboxylic acid is a hydrocarbyl-substituted salicylic acid or a derivative thereof.

38. A non-aqueous lubricant composition as claimed in claim 36 in which the carboxylic acid is a hydrocarbyl-substituted salicylic acid or a sulphurised derivative thereof.

39. A non-aqueous lubricant composition as claimed in claim 36 in which the metal of the metal salt is selected from the group consisting of calcium, magnesium and combinations thereof.

40. A non-aqueous lubricant composition as claimed in claim 37 in which the metal of the metal salt is selected from the group consisting of calcium, magnesium and combinations thereof.

41. A non-aqueous lubricant composition as claimed in claim 38 in which the metal of the metal salt is selected from the group consisting of calcium, magnesium and combinations thereof.

42. A non-aqueous lubricant composition as claimed in claim 4 in which the more than one other lubricant additive comprises at least one metallic or non-metallic detergent.

43. A non-aqueous lubricant composition as claimed in 42 in which the metallic detergent comprises at least one metal salt of at least one organic acid which is a carboxylic acid.

44. A non-aqueous lubricant composition as claimed in claim 43 in which the carboxylic acid is a hydrocarbyl-substituted salicylic acid or a derivative thereof.

45. A non-aqueous lubricant composition as claimed in claim 43 in which the carboxylic acid is a hydrocarbyl-substituted salicylic acid or a sulphurised derivative thereof.

46. A non-aqueous lubricant composition as claimed in claim 43 in which the metal of the metal salt is selected from the group consisting of calcium, magnesium and combinations thereof.

47. A non-aqueous lubricant composition as claimed in claim 44 in which the metal of the metal salt is selected from the group consisting of calcium, magnesium and combinations thereof.

48. A non-aqueous lubricant composition as claimed in claim 45 in which the metal of the metal salt is selected from the group consisting of calcium, magnesium and combinations thereof.

49. A non-aqueous lubricant composition as claimed in claim 22 in which the more than one other lubricant additive comprises at least one metallic or non-metallic detergent.

50. A non-aqueous lubricant composition as claimed in claim 49 in which the metallic detergent comprises at least one metal salt of at least one organic acid which is a carboxylic acid.

51. A non-aqueous lubricant composition as claimed in claim 50 in which the carboxylic acid is a hydrocarbyl-substituted salicylic acid or a derivative thereof.

52. A non-aqueous lubricant composition as claimed in claim 50 in which the carboxylic acid is a hydrocarbyl-substituted salicylic acid or a sulphurised derivative thereof.

53. A non-aqueous lubricant composition as claimed in claim 50 in which the metal of the metal salt is selected from the group consisting of calcium, magnesium and combinations thereof.

54. A non-aqueous lubricant composition as claimed in claim 51 in which the metal of the metal salt is selected from the group consisting of calcium, magnesium and combinations thereof.

55. A non-aqueous lubricant composition as claimed in claim 52 in which the metal of the metal salt is selected from the group consisting of calcium, magnesium and combinations thereof.

56. A non-aqueous lubricant composition as claimed in claim 1 in which the more than one other lubricant additive comprises at least one metallic or non-metallic dispersant.

57. A non-aqueous lubricant composition as claimed in claim 56 in which the dispersant is borated.

58. A non-aqueous lubricant composition as claimed in claim 4 in which the more than one other lubricant additive comprises at least one metallic or non-metallic dispersant.

59. A non-aqueous lubricant composition as claimed in claim 58 in which the dispersant is borated.

60. A non-aqueous lubricant composition as claimed in claim 22 in which the more than one other lubricant additive comprises at least one metallic or non-metallic dispersant.

61. A non-aqueous lubricant composition as claimed in claim 60 in which the dispersant is borated.

62. A non-aqueous lubricant composition comprising a major amount of an oil of lubricating viscosity and a minor amount of at least one additive which is an oil-soluble mono-, di-, or tri-glyceride of at least one hydroxy polycarboxylic acid or derivative of at least one hydroxy polycarboxylic acid as represented by the general formula (I):

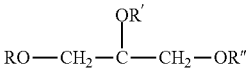

(I)

wherein RO, OR' and OR" independently represent:

—OH;

a saturated, mono-unsaturated or poly-unsaturated, branched or linear, monocarboxylic or polycarboxylic group having from 4 to 22 carbon atoms or an ether or an ester thereof;

a hydroxy polycarboxylic acid moiety or an ether and/or ester thereof provided that at least one of RO, OR' and OR" is a hydroxy polycarboxylic acid moiety or an ether and/or ester thereof.

63. The composition as claimed in claim 62 wherein, in formula (I), at least one of RO, OR' and OR" is a hydroxy polycarboxylic acid moiety or an ether and/or ester thereof, and at least one of RO, OR' and OR" is a saturated, mono-unsaturated or poly-unsaturated, branched or linear, monocarboxylic or polycarboxylic group having from 4 to 22 carbon atoms or an ester thereof.

64. The composition as claimed in claim 62 wherein, in formula (I), the hydroxy polycarboxylic moiety acid has at least one hydroxy group or derivative thereof which is in an alpha position with respect to a carboxylic moiety.

65. The composition as claimed in claim 62 wherein, in formula (I), the hydroxy polycarboxylic moiety is derivable from acids selected from the group consisting of citric acid, tartaric acid, malic acid, monohydroxy trimesic acid and hydrogenated monohydroxy trimesic acid.

* * * * *